US008771051B2

(12) United States Patent
Mattice et al.

(10) Patent No.: US 8,771,051 B2
(45) Date of Patent: Jul. 8, 2014

(54) VIDEO AND MECHANICAL SPINNING BONUS WHEEL

(75) Inventors: Harold Mattice, Gardnersville, NV (US); Chris Gadda, Las Vegas, NV (US); Chan Griswold, Reno, NV (US); Richard Wilder, Sparks, NV (US); Ricky Lew, Reno, NV (US)

(73) Assignee: IGT, Las Vegas, NV (US)

( * ) Notice: Subject to any disclaimer, the term of this patent is extended or adjusted under 35 U.S.C. 154(b) by 53 days.

(21) Appl. No.: 13/184,322

(22) Filed: Jul. 15, 2011

(65) Prior Publication Data

US 2011/0281634 A1 Nov. 17, 2011

Related U.S. Application Data

(63) Continuation of application No. 11/218,688, filed on Sep. 2, 2005.

(51) Int. Cl.
*A63F 9/24* (2006.01)

(52) U.S. Cl.
USPC ..... 463/16; 463/1; 463/20; 463/21; 463/30; 463/31; 273/138.1; 273/142 R; 273/147

(58) Field of Classification Search
CPC . G07F 17/32; G07F 17/3204; G07F 17/3211; G07F 17/3213
USPC ..... 273/138.1, 142 R, 147; 463/1, 16, 20, 463/31, 21, 30, 32, 33
See application file for complete search history.

(56) References Cited

U.S. PATENT DOCUMENTS

| | | | |
|---|---|---|---|
| 3,796,433 | A | 3/1974 | Fraley et al. |
| 3,853,324 | A | 12/1974 | Reiner et al. |
| 3,877,700 | A | 4/1975 | Moe |
| 3,923,305 | A | 12/1975 | Reiner et al. |
| 4,012,046 | A | 3/1977 | Liket |
| 4,058,026 | A | 11/1977 | Simpson |
| 4,129,304 | A | 12/1978 | Mager |
| 4,198,052 | A | 4/1980 | Gauselmann |
| 4,236,717 | A | 12/1980 | Wichinsky |

(Continued)

FOREIGN PATENT DOCUMENTS

| | | |
|---|---|---|
| AU | 2006204652 | 9/2012 |
| CN | 1550244 A | 12/2004 |

(Continued)

OTHER PUBLICATIONS

U.S. Appl. No. 60/818,127, filed Jun. 30, 2006.

(Continued)

*Primary Examiner* — David L Lewis
*Assistant Examiner* — Chase Leichliter
(74) *Attorney, Agent, or Firm* — Foley & Lardner LLP

(57) ABSTRACT

A gaming machine includes a combination inner video display and rotatable object. The inner video display and the rotatable object may be correlated together to form a reconfigurable object. Both the inner video display and the rotatable object can have segments wherein each segment may have an indicia associated with the segment, wherein the indicia can be a prize, a bonus multiplier, a progressive jackpot, a negative value, a bonus spin character, a loss of spin character, a blank space or a null character. The player will be rewarded with the corresponding prize(s) based upon the outcome of the combination inner video display and rotatable object.

15 Claims, 10 Drawing Sheets

(56) References Cited

U.S. PATENT DOCUMENTS 4,319,805 A 3/1982 Nicolas
4,353,554 A 10/1982 Fisher
4,363,485 A 12/1982 Edwall
4,373,727 A 2/1983 Hooker et al.
4,426,082 A 1/1984 Heywood et al.
4,448,419 A 5/1984 Telnaes
4,522,399 A 6/1985 Nishikawa
4,550,916 A 11/1985 Ortiz
4,582,324 A 4/1986 Koza et al.
4,586,707 A 5/1986 McNeight et al.
4,593,904 A 6/1986 Graves
4,615,527 A 10/1986 Moss
4,618,150 A 10/1986 Kimura
4,652,998 A 3/1987 Koza et al.
4,666,160 A 5/1987 Hamilton
4,695,053 A 9/1987 Vazquez, Jr. et al.
4,712,799 A 12/1987 Fraley
4,756,532 A 7/1988 Kamille
4,773,647 A 9/1988 Okada et al.
4,781,377 A 11/1988 McVean et al.
4,790,537 A 12/1988 Smyth et al.
4,805,907 A 2/1989 Hagiwara
4,871,171 A 10/1989 Rivero
4,926,327 A 5/1990 Sidley
4,936,588 A 6/1990 Rader et al.
4,948,133 A 8/1990 Helm et al.
4,964,642 A 10/1990 Kamille
5,001,632 A 3/1991 Hall-Tipping
5,083,271 A 1/1992 Thacher et al.
5,083,800 A 1/1992 Lockton
5,114,155 A 5/1992 Tillery et al.
5,116,055 A 5/1992 Tracy
5,188,363 A 2/1993 Marnell et al.
5,205,555 A 4/1993 Hamano
1,912,992 A 6/1993 Mills
5,241,139 A 8/1993 Gungl et al.
5,280,909 A 1/1994 Tracy
5,299,810 A 4/1994 Pierce et al.
5,308,065 A 5/1994 Bridgeman et al.
5,340,317 A 8/1994 Freeman
5,342,047 A 8/1994 Heidel et al.
5,342,049 A 8/1994 Wichinsky et al.
5,342,058 A 8/1994 Giovannetti
5,364,100 A 11/1994 Ludlow et al.
5,397,125 A 3/1995 Adams
5,409,225 A 4/1995 Kelly et al.
5,411,268 A 5/1995 Nelson et al.
5,411,271 A 5/1995 Mirando
5,429,507 A 7/1995 Kaplan
5,449,173 A 9/1995 Thomas et al.
5,472,197 A 12/1995 Gwiasda et al.
5,531,440 A 7/1996 Dabrowski et al.
5,536,016 A 7/1996 Thompson
5,537,251 A 7/1996 Shimada
5,542,669 A 8/1996 Charron et al.
5,544,892 A 8/1996 Breeding
5,560,603 A 10/1996 Seelig et al.
5,611,535 A 3/1997 Tiberio
5,618,045 A 4/1997 Kagan et al.
5,628,684 A 5/1997 Bouedec
5,643,088 A 7/1997 Vaughn et al.
5,645,281 A 7/1997 Hesse et al.
5,645,486 A 7/1997 Nagao et al.
5,647,798 A 7/1997 Falciglia
5,655,965 A 8/1997 Takemoto et al.
5,667,217 A 9/1997 Kelly et al.
5,669,818 A 9/1997 Thorner et al.
5,676,371 A 10/1997 Kelly et al.
5,695,188 A 12/1997 Ishibashi
5,697,611 A 12/1997 Kelly et al.
5,700,007 A 12/1997 Kelly et al.
5,700,008 A 12/1997 Lawlor et al.
5,704,612 A 1/1998 Kelly et al.
5,707,285 A 1/1998 Place et al.
5,722,891 A 3/1998 Inoue
5,733,193 A 3/1998 Allard et al.
5,743,523 A 4/1998 Kelly et al.
5,743,532 A 4/1998 Lafferty
5,755,621 A 5/1998 Marks et al.
5,758,875 A 6/1998 Giacalone, Jr.
5,766,074 A 6/1998 Cannon et al.
5,769,424 A 6/1998 Kelly et al.
5,769,716 A 6/1998 Saffari et al.
5,772,509 A 6/1998 Weiss
5,779,544 A 7/1998 Seelig et al.
5,785,595 A 7/1998 Gauselmann
5,788,573 A 8/1998 Baerlocher et al.
5,796,389 A 8/1998 Bertram et al.
5,803,451 A 9/1998 Kelly et al.
5,810,354 A 9/1998 Banyai
5,816,918 A 10/1998 Kelly et al.
5,818,430 A 10/1998 Heiser
5,823,872 A 10/1998 Prather et al.
5,823,874 A 10/1998 Adams
5,833,536 A 11/1998 Davids et al.
5,836,586 A 11/1998 Marks et al.
5,848,932 A 12/1998 Adams
5,851,148 A 12/1998 Brune et al.
5,860,648 A 1/1999 Petermeier et al.
5,871,398 A 2/1999 Schneier et al.
5,873,781 A 2/1999 Keane
5,882,258 A 3/1999 Kelly et al.
5,882,261 A 3/1999 Adams
5,888,115 A 3/1999 Shoemaker, Jr. et al.
5,889,996 A 3/1999 Adams
5,910,046 A 6/1999 Wada et al.
5,919,088 A 7/1999 Weiss
5,927,714 A 7/1999 Kaplan
5,934,672 A 8/1999 Sines et al.
5,941,770 A 8/1999 Miers et al.
5,947,820 A 9/1999 Morro et al.
5,951,397 A 9/1999 Dickinson
5,967,514 A 10/1999 Kelly et al.
5,976,015 A 11/1999 Seelig et al.
5,976,019 A 11/1999 Ikeda et al.
5,977,867 A 11/1999 Blouin
5,993,315 A 11/1999 Strider et al.
5,997,400 A 12/1999 Seelig et al.
5,997,401 A 12/1999 Crawford
6,007,426 A 12/1999 Kelly et al.
6,012,722 A 1/2000 Petermeier et al.
6,015,344 A 1/2000 Kelly et al.
6,015,346 A 1/2000 Bennett
6,017,033 A 1/2000 Keller
6,019,369 A 2/2000 Nakagawa et al.
6,019,374 A 2/2000 Breeding
6,027,115 A 2/2000 Griswold et al.
6,030,291 A 2/2000 Maki et al.
6,033,307 A 3/2000 Vancura
6,047,963 A 4/2000 Pierce et al.
6,048,271 A 4/2000 Barcelou
6,050,895 A 4/2000 Luciano, Jr. et al.
6,062,981 A 5/2000 Luciano, Jr. et al.
6,067,081 A 5/2000 Hahlganss et al.
6,071,192 A 6/2000 Weiss
6,086,066 A 7/2000 Takeuchi et al.
6,089,976 A 7/2000 Schneider et al.
6,089,977 A 7/2000 Bennett
6,102,400 A 8/2000 Scott et al.
6,102,402 A 8/2000 Scott et al.
6,102,798 A 8/2000 Bennett
6,110,039 A 8/2000 Oh
6,110,041 A 8/2000 Walker et al.
6,110,043 A 8/2000 Olsen
6,113,098 A 9/2000 Adams
6,117,007 A 9/2000 Matsuyama et al.
6,117,008 A 9/2000 Machiguchi
6,120,031 A 9/2000 Adams
6,125,385 A 9/2000 Wies et al.
6,126,541 A 10/2000 Fuchs
6,126,542 A 10/2000 Fier
6,126,547 A 10/2000 Ishimoto
6,135,453 A 10/2000 Srichayaporn
6,135,884 A 10/2000 Hedrick et al.

(56) References Cited

U.S. PATENT DOCUMENTS 6,135,885 A 10/2000 Lermusiaux
6,139,013 A 10/2000 Pierce et al.
6,142,873 A 11/2000 Weiss et al.
6,146,273 A 11/2000 Olsen
6,149,156 A 11/2000 Feola
6,159,095 A 12/2000 Frohm et al.
6,159,097 A 12/2000 Gura
6,165,070 A 12/2000 Nolte et al.
6,169,595 B1 1/2001 Manne
6,174,233 B1 1/2001 Sunaga et al.
6,174,235 B1 1/2001 Walker et al.
6,174,237 B1 1/2001 Stephenson
6,190,255 B1 2/2001 Thomas et al.
6,193,606 B1 2/2001 Walker et al.
6,201,533 B1 3/2001 Rosenberg et al.
6,210,279 B1 4/2001 Dickinson
6,219,032 B1 4/2001 Rosenberg et al.
6,220,593 B1 4/2001 Pierce et al.
6,220,961 B1 4/2001 Keane et al.
6,224,482 B1 5/2001 Bennett
6,224,483 B1 5/2001 Mayeroff
6,224,484 B1 5/2001 Okuda et al.
6,224,485 B1 5/2001 Dickinson et al.
6,227,971 B1 5/2001 Weiss
6,231,442 B1 5/2001 Mayeroff
6,234,897 B1 5/2001 Frohm et al.
6,238,288 B1 5/2001 Walker et al.
6,251,013 B1 6/2001 Bennett
6,251,014 B1 6/2001 Stockdale et al.
6,254,481 B1 7/2001 Jaffe
6,261,177 B1 7/2001 Bennett
6,267,669 B1 7/2001 Luciano, Jr. et al.
6,270,408 B1 8/2001 Sakamoto et al.
6,270,410 B1 8/2001 DeMar et al.
6,270,411 B1 8/2001 Gura et al.
6,270,412 B1 8/2001 Crawford et al.
6,279,910 B1 8/2001 de Keller
6,287,194 B1 9/2001 Okada et al.
6,287,197 B1 9/2001 Dickinson et al.
6,290,603 B1 9/2001 Luciano, Jr.
6,293,866 B1 9/2001 Walker et al.
6,296,568 B1 10/2001 Tracy
6,302,790 B1 10/2001 Brossard
6,308,953 B1 10/2001 Nagano
6,309,299 B1 10/2001 Weiss
6,309,300 B1 10/2001 Glavich
6,312,334 B1 11/2001 Yoseloff
6,315,660 B1 11/2001 DeMar et al.
6,315,663 B1 11/2001 Sakamoto
6,319,124 B1 11/2001 Baerlocher et al.
6,322,309 B1 11/2001 Thomas et al.
6,328,649 B1 12/2001 Randall et al.
6,336,863 B1 * 1/2002 Baerlocher et al. ..... 463/27
6,338,678 B1 1/2002 Seelig et al.
6,340,158 B2 1/2002 Pierce et al.
6,343,988 B1 2/2002 Walker et al.
6,344,861 B1 2/2002 Naughton et al.
6,346,043 B1 2/2002 Colin et al.
6,347,813 B1 2/2002 Star et al.
6,347,996 B1 2/2002 Gilmore et al.
6,364,765 B1 4/2002 Walker et al.
6,364,766 B1 4/2002 Anderson et al.
6,364,768 B1 4/2002 Acres et al.
6,366,272 B1 4/2002 Rosenberg et al.
6,375,187 B1 4/2002 Baerlocher
6,379,245 B2 4/2002 De Keller
6,386,974 B1 5/2002 Adams
6,406,369 B1 6/2002 Baerlocher et al.
6,413,160 B1 7/2002 Vancura
6,413,161 B1 7/2002 Baerlocher et al.
6,431,711 B1 8/2002 Pinhanez
6,435,511 B1 8/2002 Vancura et al.
6,443,837 B1 9/2002 Jaffe et al.
6,446,965 B1 * 9/2002 Boulton ..... 273/142 R
6,450,884 B1 9/2002 Seelig et al.
6,454,649 B1 9/2002 Mattice et al.
6,454,651 B1 9/2002 Yoseloff
6,464,581 B1 10/2002 Yoseloff et al.
6,467,771 B1 10/2002 deKeller
6,476,798 B1 11/2002 Bertram et al.
6,485,367 B1 11/2002 Joshi
6,488,580 B1 12/2002 Robb
6,503,147 B1 1/2003 Stockdale et al.
6,506,118 B1 1/2003 Baerlocher et al.
6,517,433 B2 2/2003 Loose et al.
6,522,312 B2 2/2003 Ohshima et al.
6,533,660 B2 3/2003 Seelig et al.
6,533,664 B1 3/2003 Crumby
6,537,150 B1 3/2003 Luciano et al.
6,554,704 B2 4/2003 Nicastro et al.
6,563,487 B2 5/2003 Martin et al.
6,572,473 B1 6/2003 Baerlocher
6,582,306 B1 6/2003 Kaminkow
6,599,193 B2 7/2003 Baerlocher et al.
6,602,137 B2 8/2003 Kaminkow et al.
6,605,002 B2 8/2003 Baerlocher
6,607,438 B2 8/2003 Baerlocher et al.
6,626,756 B2 9/2003 Sugimoto
6,632,140 B2 10/2003 Berman et al.
6,632,141 B2 10/2003 Webb et al.
6,645,071 B2 11/2003 Perrie et al.
6,648,754 B2 11/2003 Baerlocher et al.
6,648,758 B2 11/2003 Bennett et al.
6,656,040 B1 12/2003 Brosnan et al.
6,692,003 B2 2/2004 Potter et al.
6,705,944 B2 3/2004 Luciano
6,722,976 B2 4/2004 Adams
6,733,389 B2 5/2004 Webb et al.
6,739,970 B2 5/2004 Luciano
6,761,313 B2 7/2004 Hsieh et al.
6,761,632 B2 7/2004 Nolz
6,767,284 B1 7/2004 Koza
6,769,983 B2 8/2004 Slomiany
6,780,103 B2 8/2004 Bansemer et al.
6,780,111 B2 8/2004 Cannon et al.
6,786,824 B2 9/2004 Cannon
6,793,577 B1 9/2004 Wilkins et al.
6,811,482 B2 11/2004 Letovsky
6,817,948 B2 11/2004 Pascal et al.
6,827,646 B2 12/2004 Adams
6,832,959 B2 12/2004 Baerlocher
6,837,793 B2 1/2005 McClintic
6,843,725 B2 1/2005 Nelson
6,852,027 B2 2/2005 Kaminkow et al.
6,857,959 B1 2/2005 Nguyen
6,860,811 B1 3/2005 Wilkins
6,863,606 B1 3/2005 Berg et al.
6,869,361 B2 3/2005 Sharpless et al.
6,893,342 B1 5/2005 Singer et al.
6,905,405 B2 6/2005 McClintic
6,921,335 B2 7/2005 Rodgers et al.
6,934,607 B2 8/2005 Blaine
6,942,571 B1 9/2005 McAllister et al.
7,048,631 B2 * 5/2006 Goins et al. ..... 463/31
7,056,210 B2 6/2006 Bansemer et al.
7,166,029 B2 1/2007 Enzminger
7,175,524 B2 2/2007 Bansemer et al.
7,179,169 B2 2/2007 Beaulieu et al.
7,192,344 B2 3/2007 Baerlocher
7,306,520 B2 * 12/2007 Kaminkow et al. ..... 463/20
7,309,284 B2 12/2007 Griswold et al.
7,311,598 B2 12/2007 Kaminkow et al.
7,311,604 B2 12/2007 Kaminkow et al.
7,384,339 B2 6/2008 LeMay et al.
7,452,276 B2 11/2008 Loose et al.
7,559,840 B1 7/2009 D'Avanzo
7,744,460 B2 6/2010 Walker et al.
8,092,304 B2 1/2012 Hedrick et al.
8,100,761 B2 1/2012 Bennett
8,210,944 B2 * 7/2012 Mead ..... 463/31
8,262,457 B2 * 9/2012 Ansari et al. ..... 463/20
2002/0049084 A1 4/2002 Hughs-Baird et al.
2002/0107065 A1 8/2002 Rowe
2002/0128055 A1 9/2002 Adams

(56) References Cited

U.S. PATENT DOCUMENTS

| | | | | |
|---|---|---|---|---|
| 2002/0130847 | A1 | 9/2002 | Conzola et al. | |
| 2002/0151342 | A1 | 10/2002 | Tracy et al. | |
| 2002/0160825 | A1 | 10/2002 | Nicastro et al. | |
| 2002/0198038 | A1 | 12/2002 | Adams | |
| 2003/0013519 | A1 | 1/2003 | Bennett | |
| 2003/0040355 | A1 | 2/2003 | Baerlocher | |
| 2003/0060269 | A1 | 3/2003 | Paulsen et al. | |
| 2003/0064773 | A1 | 4/2003 | Baerlocher et al. | |
| 2003/0064799 | A1 | 4/2003 | Goins et al. | |
| 2003/0069063 | A1 | 4/2003 | Bilyeu et al. | |
| 2003/0076307 | A1 | 4/2003 | Krajewski et al. | |
| 2003/0100361 | A1 | 5/2003 | Sharpless et al. | |
| 2003/0104854 | A1 | 6/2003 | Cannon | |
| 2003/0104860 | A1 | 6/2003 | Cannon et al. | |
| 2003/0114218 | A1 | 6/2003 | McClintic | |
| 2003/0114219 | A1 | 6/2003 | McClintic | |
| 2003/0114220 | A1 | 6/2003 | McClintic | |
| 2003/0119576 | A1 | 6/2003 | McClintic et al. | |
| 2003/0119581 | A1 | 6/2003 | Cannon et al. | |
| 2003/0125102 | A1 | 7/2003 | Cannon | |
| 2003/0125107 | A1 | 7/2003 | Cannon | |
| 2003/0157980 | A1 | 8/2003 | Loose et al. | |
| 2003/0171144 | A1 | 9/2003 | Letovsky | |
| 2003/0195034 | A1 | 10/2003 | Dunaevsky | |
| 2003/0232640 | A1 | 12/2003 | Walker et al. | |
| 2004/0048659 | A1 | 3/2004 | Seelig et al. | |
| 2004/0053661 | A1* | 3/2004 | Jones et al. | 463/16 |
| 2004/0053665 | A1 | 3/2004 | Baerlocher | |
| 2004/0053687 | A1 | 3/2004 | Nordman et al. | |
| 2004/0116173 | A1 | 6/2004 | Baerlocher | |
| 2004/0116174 | A1 | 6/2004 | Baerlocher et al. | |
| 2004/0166930 | A1 | 8/2004 | Beaulieu et al. | |
| 2004/0171417 | A1* | 9/2004 | Beaulieu et al. | 463/20 |
| 2004/0198490 | A1 | 10/2004 | Bansemer et al. | |
| 2004/0214630 | A1 | 10/2004 | Mayeroff | |
| 2004/0235558 | A1 | 11/2004 | Beaulieu et al. | |
| 2004/0242315 | A1 | 12/2004 | Paulsen et al. | |
| 2004/0248640 | A1* | 12/2004 | Kaminkow et al. | 463/20 |
| 2004/0266515 | A1 | 12/2004 | Gauselmann | |
| 2004/0266536 | A1 | 12/2004 | Mattice et al. | |
| 2005/0020340 | A1 | 1/2005 | Cannon | |
| 2005/0026664 | A1 | 2/2005 | Bansemer et al. | |
| 2005/0037843 | A1 | 2/2005 | Wells et al. | |
| 2005/0049048 | A1 | 3/2005 | Wilder et al. | |
| 2005/0060051 | A1 | 3/2005 | Mattice et al. | |
| 2005/0075159 | A1 | 4/2005 | Kaminkow et al. | |
| 2005/0101384 | A1 | 5/2005 | Parham | |
| 2005/0119039 | A1* | 6/2005 | Berman et al. | 463/16 |
| 2005/0153776 | A1 | 7/2005 | LeMay et al. | |
| 2005/0181853 | A1 | 8/2005 | Baerlocher | |
| 2005/0197181 | A1 | 9/2005 | Jaffe | |
| 2006/0038965 | A1 | 2/2006 | Hennes | |
| 2006/0046822 | A1 | 3/2006 | Kaminkow et al. | |
| 2006/0046823 | A1 | 3/2006 | Kaminkow et al. | |
| 2006/0111168 | A1 | 5/2006 | Nguyen et al. | |
| 2006/0135248 | A1 | 6/2006 | Anderson et al. | |
| 2006/0247023 | A1 | 11/2006 | Inoue | |
| 2007/0010326 | A1 | 1/2007 | Seelig et al. | |
| 2007/0054723 | A1 | 3/2007 | Mattice et al. | |
| 2007/0054730 | A1 | 3/2007 | Mattice et al. | |
| 2007/0060270 | A1 | 3/2007 | Seelig et al. | |
| 2007/0069460 | A1 | 3/2007 | Hein et al. | |
| 2007/0072668 | A1 | 3/2007 | Hein et al. | |
| 2007/0149281 | A1 | 6/2007 | Gadda et al. | |
| 2007/0149292 | A1 | 6/2007 | Kaminkow et al. | |
| 2007/0218982 | A1 | 9/2007 | Baerlocher | |
| 2007/0232377 | A1 | 10/2007 | Haag et al. | |
| 2008/0004104 | A1 | 1/2008 | Durham et al. | |
| 2008/0020816 | A1 | 1/2008 | Griswold et al. | |
| 2008/0108422 | A1 | 5/2008 | Hedrick et al. | |
| 2008/0113712 | A1 | 5/2008 | Leblanc et al. | |
| 2009/0104964 | A1 | 4/2009 | Snow | |
| 2009/0312083 | A1 | 12/2009 | Rasmussen | |
| 2011/0118013 | A1 | 5/2011 | Mattice et al. | |

FOREIGN PATENT DOCUMENTS

| | | | |
|---|---|---|---|
| EP | 0375190 | | 6/1990 |
| EP | 0918307 | | 5/1999 |
| EP | 1079344 | | 2/2001 |
| GB | 1242298 | | 8/1971 |
| GB | 2072395 | | 2/1981 |
| GB | 2066991 | | 7/1981 |
| GB | 2100905 | | 1/1983 |
| GB | 2182186 | | 5/1987 |
| GB | 2191030 | | 12/1987 |
| GB | 2207268 | | 1/1989 |
| GB | 2226436 | | 6/1990 |
| GB | 2242300 | | 9/1991 |
| GB | 2258164 | | 2/1993 |
| GB | 2262642 | | 6/1993 |
| JP | 06-134102 | A | 5/1994 |
| JP | 2004-147776 | A | 5/2004 |
| NZ | 508626 | | 11/2001 |
| WO | 96/08295 | | 3/1996 |
| WO | 96/25725 | | 8/1996 |
| WO | 98/51384 | | 11/1998 |
| WO | 03/011409 | A2 | 2/2003 |
| WO | 2007/024202 | | 3/2007 |
| WO | 2008/109762 | | 9/2008 |

OTHER PUBLICATIONS

US Office Action dated Sep. 30, 2009 issued in U.S. Appl. No. 11/218,688.

US Office Action Final dated Apr. 9, 2010 issued in U.S. Appl. No. 11/218,688.

US Office Action dated Jul. 1, 2009 issued in U.S. Appl. No. 11/683,296.

US Office Action Final dated Dec. 30, 2009 issued in U.S. Appl. No. 11/683,296.

US Office Action dated Dec. 30, 2009 issued in U.S. Appl. No. 11/683,296.

US Office Action dated 10/1/09 issued in U.S. Appl. No. 11/557,876.

US Office Action dated Oct. 21, 2010 issued in U.S. Appl. No. 11/557,876.

US Office Action dated Mar. 8, 2011 issued in U.S. Appl. No. 11/557,876.

US Office Action dated May 13, 2011 issued in U.S. Appl. No. 11/557,876.

US Office Action dated Jun. 1, 2010 issued in U.S. Appl. No. 11/557,876.

US Office Action dated Apr. 1, 2011, issued in U.S. Appl. No. 11/873,976.

AU Examiner's First Report dated Jan. 20, 2011 issued in Application No. 2006204652.

PCT International Search Report and Written Opinion for PCT/US2008/056075 dated Sep. 30, 2008.

International Preliminary Report on Patentability dated Sep. 8, 2009 for PCT Application No. PCT/US2008/056075.

Pico Projector Displays: Overview (2009), Microvision, Inc., sales document retrieved from the Internet at http://www.microvision.com/pico_projector, on Apr. 26, 2010.

PicoP™ Evaluation Kit (PEK) (2009), Preliminary Specifications, Document No. DA0124619, Microvision, Inc., Redmond, WA, 1 page.

Cyclone Advertisement, written by Innovative Concepts in Entertainment, Inc., published prior to Oct. 17, 2007.

Description of Poker, written by Hoyle's Rules of Games published 1946-1983.

Fey, Slot Machines, A Pictorial History of the First 100 Years, Liberty Belle Books, 1983, pp. 215, 219.

The Inside Straight Article, written by IGT, published in 2002.

Mikohn Ripley's Believe It or Not Article, written by Strictly Slots, published in Jun. 2001.

Mountain Coin Machine Distributing—Redemption Games—Cyclone™ Advertisement [online] [retrieved on Feb. 28, 2002]. Retrieved from the Internet at <URL: www.mountaincoin.com>.

Poker Speed Change Input Screens by IGT, published prior to Oct. 17, 2007.

(56) References Cited

OTHER PUBLICATIONS

Press Your Luck Article, written by Strictly Slots, published in 2000.
Primetime Amusements Redemption Games Advertisement [online] [retrieved on Feb. 28, 2002]. Retrieved from the Internet at <URL: http://www.primetimeamusements.com/redemption.htm>.
Reel Spin Stop Input Screens by IGT, published prior to Oct. 17, 2007.
Table Games Advertisement Brochure, published by ShuffleMaster in 2000.
Weiner Distributing ICE Cyclone™ Advertisement [online] [retrieved on Feb. 28, 2002]. Retrieved from the Internet at <URL: www.winerd.com>.
US Office Action dated Aug. 8, 2011 issued in U.S. Appl. No. 11/218,688.
US Final Office Action dated Apr. 2, 2012 issued in U.S. Appl. No. 11/218,688.
US Office Action dated Mar. 2, 2012 issued in U.S. Appl. No. 11/683,296.
US Notice of Allowance dated Aug. 12, 2011 issued in U.S. Appl. No. 11/557,876.
US Notice of Allowance dated Oct. 27, 2011 issued in U.S. Appl. No. 11/557,876.
US Office Action dated Apr. 6, 2012, issued in U.S. Appl. No. 12/619,308.
US Final Office Action dated Oct. 23, 2012, issued in U.S. Appl. No. 12/619,308.
AU Examiner's Second Report dated Dec. 13, 2011 issued in Application No. 2006204652.
AU Examiner's Third Report dated Feb. 20, 2012 issued in Application No. 2006204652.
AU Notice of Acceptance dated May 29, 2012 issued in Application No. 2006204652.
AU Examiner's First Report dated Jan. 24, 2012 issued in Application No. 2008222780.
Third Party Submission submitted in U.S. Appl. No. 13/184,322 on Jan. 17, 2012.

* cited by examiner

VIDEO AND MECHANICAL SPINNING BONUS WHEEL

CROSS-REFERENCE TO RELATED APPLICATIONS

This application is a continuation of and claims priority to co-pending U.S. patent application Ser. No. 11/218,688, filed on Sep. 2, 2005, entitled "VIDEO AND MECHANICAL SPINNING BONUS WHEEL," under 35 U.S.C. §119(e) and is incorporated herein by reference in its entirety for all purposes.

TECHNICAL FIELD

The present invention relates generally to gaming machines and systems, and more specifically to the combination of an inner video display and an outer mechanized rotatable object that has the ability to rotate around the inner video display in gaming machines and systems.

BACKGROUND

Casinos and other forms of gaming comprise a growing multi-billion dollar industry both domestically and abroad, with electronic and microprocessor based gaming machines being more popular than ever. In a typical electronic gaming machine, such as a slot machine, video poker machine, video keno machine or the like, a game play is initiated through a player wager of money or credit, whereupon the gaming machine determines a game outcome, presents the game outcome to the player and then potentially dispenses an award of some type, including a monetary award, depending upon the game outcome. Many additional gaming machine components, features and programs have been made possible in recent years through this proliferation of electronic gaming machines, including those involving linked progressive jackpots, player tracking and loyalty points programs, and various forms of cashless gaming, among other items. Many of these added components, features and programs can involve the implementation of various back-end and/or networked systems, including more hardware and software elements, as is generally known.

Electronic and microprocessor based gaming machines themselves can include various hardware and software components to provide a wide variety of game types and game playing capabilities, with such hardware and software components being generally well known in the art. A typical electronic gaming machine will have a central processing unit ("CPU") or master gaming controller ("MGC") that controls various combinations of hardware and software devices and components that encourage game play, allow a player to play a game on the gaming machine and control payouts and other awards. Software components can include, for example, boot and initialization routines, various game play programs and subroutines, credit and payout routines, image and audio generation programs, various component modules and a random number generator, among others. Hardware devices and peripherals can include, for example, bill validators, coin acceptors, card readers, keypads, buttons, levers, touch screens, coin hoppers, player tracking units and the like.

In addition, each gaming machine can have various audio and visual display components that can include, for example, speakers, display panels, belly and top glasses, exterior cabinet artwork, lights, and top box dioramas, as well as any number of video displays of various types to show game play and other assorted information, with such video display types including, for example, a cathode ray tube ("CRT"), a liquid crystal display ("LCD"), a light emitting diode ("LED"), a flat panel display and a plasma display, among others. Apparatuses and methods for providing displays in gaming machines and/or within a casino are generally well known, and instances of such apparatuses and methods can be found in, for example, U.S. Pat. Nos. 6,135,884; 6,251,014; and 6,503,147, all of which are incorporated herein by reference in their entirety and for all purposes. Such video displays can be used to simulate mechanical gaming reels, whereby all elements of the displayed wheels are controlled and displayed electronically. Alternatively, physical gaming reels may be displayed behind a main display glass or other like viewing element, with the rotation and positioning of these physically present gaming reels being determined and controlled electronically, as is known in the art.

Various methods of gaining and maintaining interest in game play include designing and providing gaming machines with intriguing and different themes, game types, artwork, visual displays, sounds and the like. One attractive feature for many players is the use of a mechanical rotating bonus wheel or a virtual animated bonus wheel in a gaming machine, particularly where the bonus wheel is integrated with game play and/or other pertinent presentations to a game player and instances of such apparatuses and methods can be found in, for example, in U.S. Pat. No. 5,788,573, 6,224,483 or in the Wheel of Fortune® Gaming Machines. The bonus wheel tends to be relatively dramatic and attracts players due to the excitement of playing the bonus round. Unfortunately, these types of mechanized wheel-based games can often be inflexible and cannot be reconfigured once the physical values are placed on the mechanized wheel. In order to reconfigure the wheel or the value on the wheels, a technician would have to take the gaming machine apart. This would create downtime for the gaming machine and the gaming machine would not generate any profit during this downtime.

While existing systems and methods for mechanized bonus wheels in gaming machines and gaming systems have been adequate in the past, improvements and better systems and methods are usually welcomed and encouraged. In light of the foregoing, it is desirable to develop gaming methods and gaming systems that involve the implementation of a combination inner video display and outer mechanized rotatable object that can be reconfigurable.

SUMMARY

It is an advantage of the present invention to provide improved systems and methods for invoking a combination inner video display and an outer mechanized rotatable object (hereafter "rotatable object") in a gaming machine or system. This is accomplished in many embodiments by providing within or about a gaming machine or system an inner video display and a rotatable object.

According to several embodiments of the present invention, the disclosed systems and methods involve a gaming machine and/or gaming system adapted for accepting a wager, playing a game based on the wager and granting a payout based on the result of the game. The gaming machine or system can include the MGC adapted to control one or more game aspects, and control the inner video display and the rotatable object.

One embodiment includes an actual gaming machine, the gaming machine is adapted for accepting a wager, playing a game based on the wager and granting a payout based on the result of the game, the gaming machine comprising an inner video display; and a rotatable object that is adapted to rotate around the inner video display. The rotatable object can be a wheel, an indicator or any other rotatable device. The indicator, such as a pointer, would identify a location on the inner video display.

According to one embodiment of the present invention, a provided system involves a server configured for sending and receiving data; one or more gaming machines that communicate with the server, wherein at least one gaming machine includes an inner video display and a rotatable object that rotates around the inner video display.

According to one embodiment of the present invention, a provided method involves accepting a wager at a gaming machine; displaying an electronic image on a inner video display; and rotating an object around the inner video display.

According to one embodiment of the present invention, a provided method involves accepting a wager at the primary game; triggering an event at the primary game that initiates a bonus game, wherein the bonus game includes: displaying a video on a inner video display and rotating an object around the inner video display.

According to one embodiment of the present invention, a provided method involves accepting a wager at the gaming machine; displaying an electronic image on the inner video display; determining whether to rotate the rotatable object around the inner video display; and rotating the rotatable object based upon the determination.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive systems and methods for providing a combination inner video display and rotatable object. These drawings in no way limit any changes in form and detail that may be made to the invention by one skilled in the art without departing from the spirit and scope of the invention.

DETAILED DESCRIPTION

Figure 1:
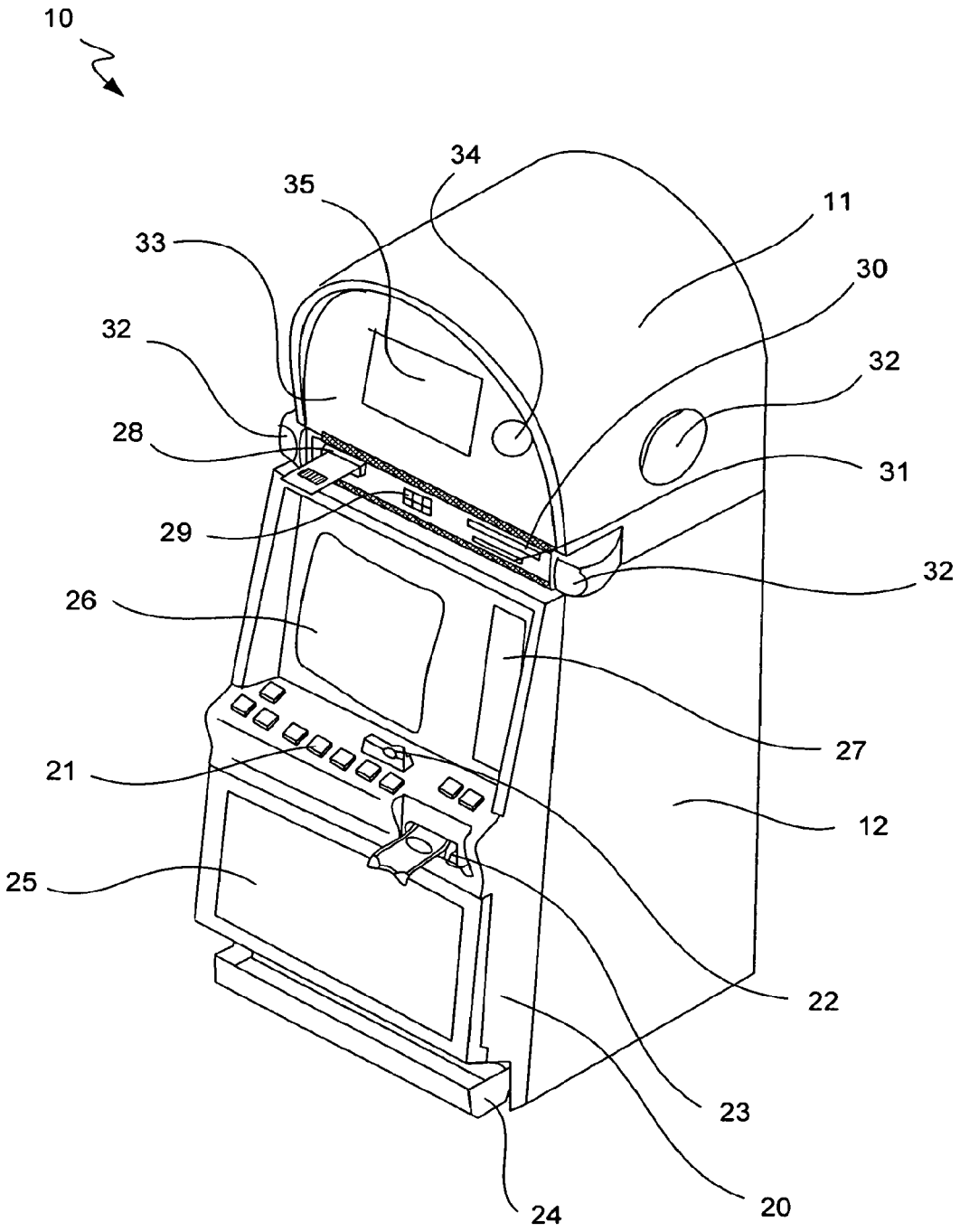
FIG. 1 illustrates in perspective view an exemplary gaming machine.

Exemplary applications of systems and methods according to the present invention are described in this section. These examples are being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following example should not be taken as definitive or limiting either in scope or setting.

In the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used and changes may be made without departing from the spirit and scope of the invention.

One advantage of the present invention is the introduction of a gaming machine, methods and systems that enables the casino the flexibility to alter the configuration of an inner video display and a rotatable object. This is accomplished in part by the introduction of a combination inner video display and rotatable object.

The rotatable object provides a visual effect of a mechanical device, such as a rotating mechanical wheel, which may be more appealing to a game player playing a game on a gaming machine utilizing the device. The inner video display is reconfigurable and allows the information displayed on the device to be varied.

One advantage of the combination inner video display and outer rotatable object is that it allows game designers greater flexibility since the game designer will no longer be confined to a printed fix object or wheel. The images may be varied during the course of the play of a game of chance or a bonus game. Further, the video capabilities may also allow a player or a casino operator to reconfigure the information displayed on the inner video display to suit their needs or preferences.

As an introduction to the various embodiments described herein, three specific examples under particular implementations of the present invention will now be provided. It will be readily appreciated that the following examples are picked from a potentially infinite number of possibilities that may occur under the present invention, such that these examples are not limiting in any way. According to the first embodiment, the inner video display and the rotatable object are configured as a wheel where the inner video display is controlled by a video controller (See for example, FIG. 2B). The inner wheel displays segments and each segment may have an indicia located within the segment.

During operation of the wheel, a virtual tile may mask one or more of the segments and their corresponding indicia. The gaming machine may be operable to receive an input that allows a segment to be selected. After receiving an input indicating a selection of the segment or under control of the master gaming controller on the gaming machine, the virtual tile may be removed to reveal an underlying indicia to the game player.

The inner wheel may be surrounded by a mechanically-driven outer wheel that has the ability to rotate around the inner video display. A mechanized wheel controller controls the mechanized outer wheel. In one embodiment, the gaming machine's MGC coordinates output from the video controller and from the mechanized wheel controller. The output from the controllers may be coordinated so that images displayed on the inner video appear to move in sync with the motion of the mechanized outer wheel. In various embodiments of the present invention, a direction of rotation, a speed of rotation and an axis of rotation for a rotatable object may be varied.

For example, on a mechanized outer wheel divided into pie shaped segments, a motion of the combination video-mechanical wheel may be triggered by an event that occurs during game play. Then, the MGC may set the outer mechanized wheel in motion and then display pie shaped images on the inner video display that appear to rotate in sync with the outer mechanized rotatable wheel until the wheel comes to rest. In one instance, an outside pointer, attached to the video-mechanical wheel, may be used to indicate a location of on the video-mechanical wheel. The pointer may be a physical device attached to the video-mechanical wheel or may be generated as an image on the inner video display. During operation of the video-mechanical wheel, different indicia displayed on the inner video display may appear to rotate through the location indicated by the pointer. When the mechanical portion of the video-mechanical wheel comes to rest, a prize indicated by the indicia at the location of the pointer may be awarded to the player.

Figure 2:
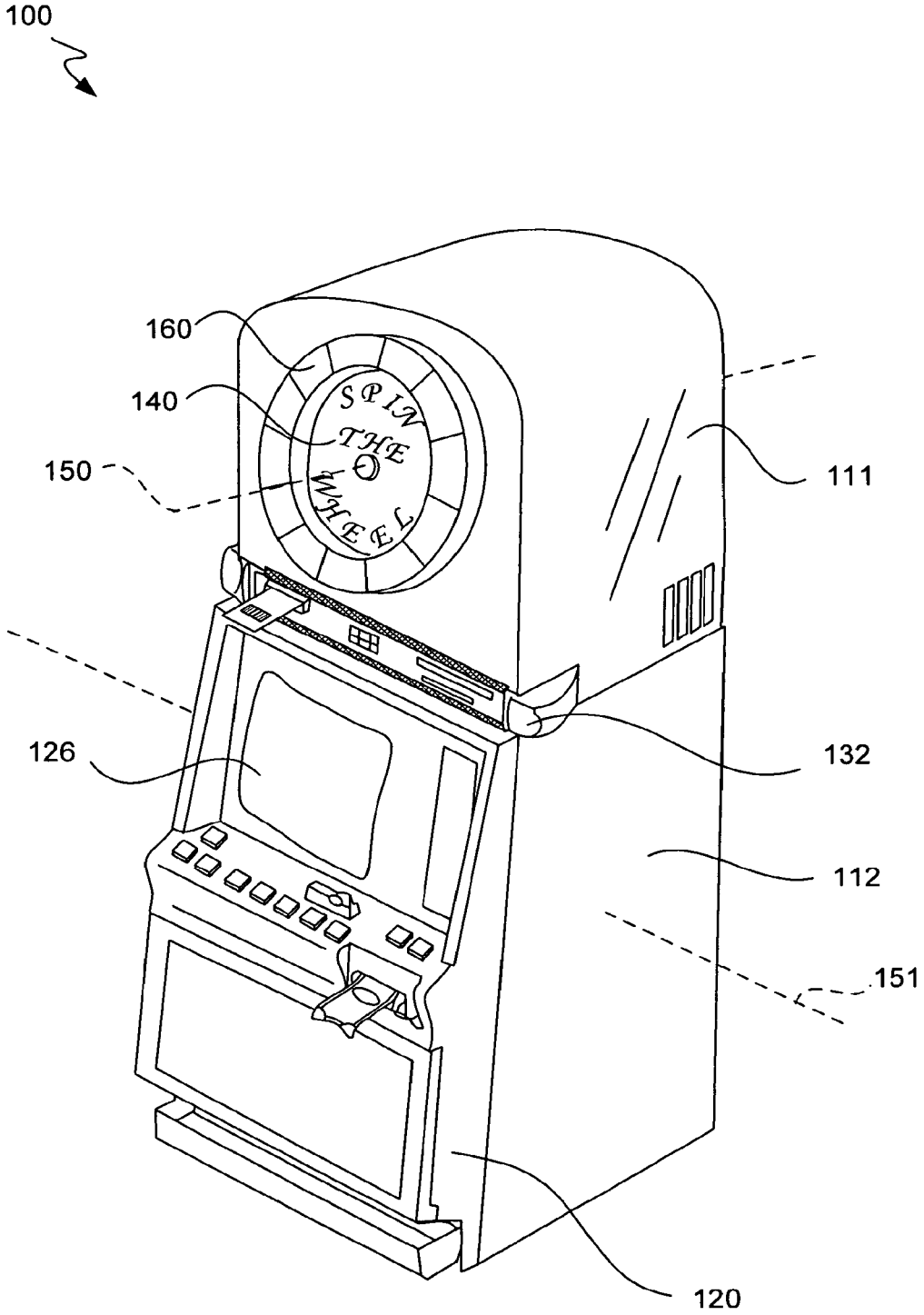
FIG. 2 illustrates in perspective view of an alternative gaming machine according to one embodiment of the present invention.

According to the second embodiment, a mechanized indicator that can rotate around the inner video display is provided (see for example, FIG. 2). One application of the indicator, such as a pointer, may be to identify a location on the inner video display. The pointer can be controlled by a pointer controller. Once the controller has initiated the mechanized pointer to rotate around the inner video display, the controller will determine where the mechanized pointer will stop along the inner video display. It will be appreciated that the MGC or a server located on a network can control the positioning of the mechanized pointer. The MGC or the server can control the pointer by providing high-level commands that are interpreted by a logic device coupled to the pointer, by providing low-level commands that directly operate the pointer or by providing a combination of low-level and high-level commands. A position of the pointer may be used to select indicia within a segment of the inner video display. In some instances, the player is rewarded with the award that is located within that segment.

Figure 4A:
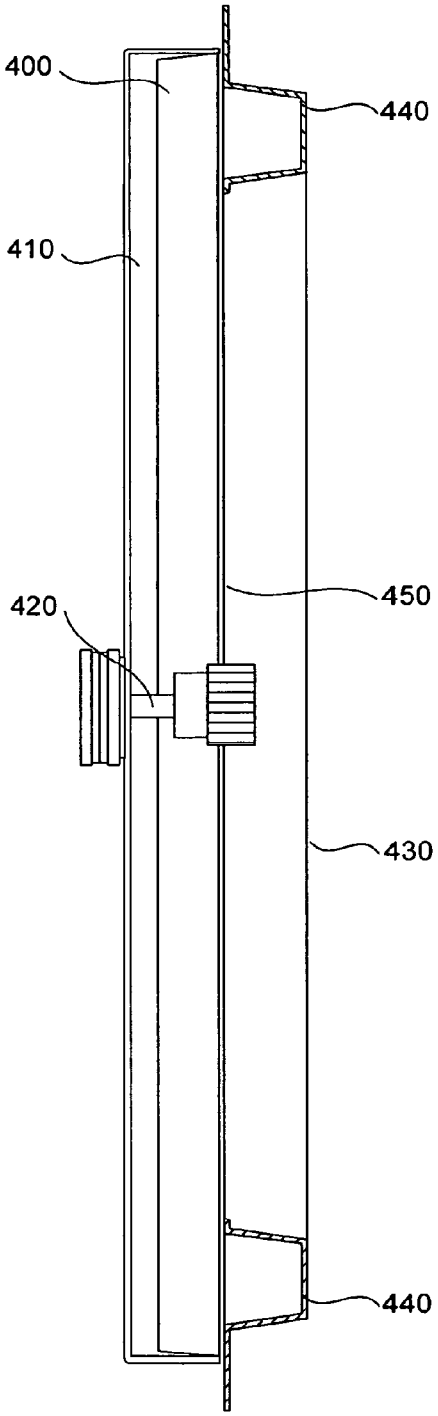
FIG. 4A illustrates a cross-sectional view of FIG. 3A displaying a rotatable object being disposed above the inner video display.
Figure 4B:
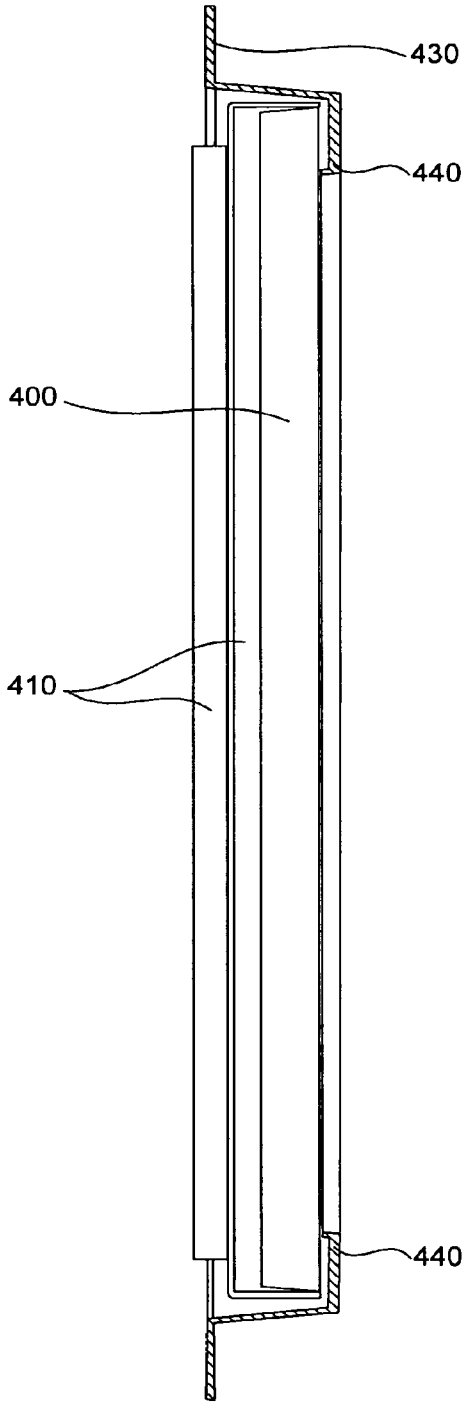
FIG. 4B illustrates a cross-sectional view of FIG. 3C displaying the rotatable object being disposed around the inner video display.

According to the third embodiment, the outer mechanized wheel may be disposed around the inner video display (see for example, FIG. 4B). The outer mechanized wheel may have a plurality of segments, each segment having an indicia located within. In this embodiment, the outer wheel rotates around the inner video display. The inner video display may display an inner pointer image that is used to select indicia on the outer wheel, such as when the outer wheel comes to rest. In some instances, an award, such as a credit value, a credit multiplier or a non-monetary prize associated with the indicia indicated by the position of the pointer is rewarded to the player.

Although the present invention is directed primarily to gaming machines and systems, it is worth noting that some of the apparatuses, systems and methods disclosed herein might be adaptable for use in other types of devices, systems or environments, as applicable, such that their use is not restricted exclusively to gaming machines and contexts. Such other adaptations may become readily apparent upon review of the inventive apparatuses, systems and methods illustrated and discussed herein.

Referring first to FIG. 1, an exemplary gaming machine is illustrated in perspective view. Gaming machine 10 includes a top box 11 and a main cabinet 12, which generally surrounds the machine interior (not shown) and is viewable by users. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to the main door are typically one or more player-input switches or buttons 21, one or more money or credit acceptors, such as a coin acceptor 22 and a bill or ticket validator 23, a coin tray 24, and a belly glass 25. Viewable through main door 20 is a primary video display monitor 26 and one or more information panels 27. The primary video display monitor 26 will typically be a cathode ray tube, high resolution flat-panel LCD, plasma/LED display or other conventional or other type of appropriate video monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may also contain a bill or ticket validator 28, a key pad 29, one or more additional displays 30, a card reader 31, one or more speakers 32, a top glass 33, one or more cameras 34, and a secondary video display monitor 35, which can similarly be a cathode ray tube, a high resolution flat-panel LCD, a plasma/LED display or any other conventional or other type of appropriate video monitor. Alternatively, secondary display monitor 35 might also be foregone in place of other displays, such as gaming reels or other mechanical devices with indicia/symbols. These mechanical device may include other moving components, such as, for example, one or more movable dice, a spinning wheel or a rotating display, among others. It will be understood that many makes, models, types and varieties of gaming machines exist, that not every such gaming machine will include each of the foregoing items, and that many gaming machines will include other items not described above.

With respect to the basic gaming abilities provided, it will be readily understood that gaming machine 10 can be adapted for presenting and playing any of a number of gaming events, particularly games of chance involving a player wager and potential monetary payout, such as, for example, a wager on a sporting event or general play as a slot machine game, a keno game, a video poker game, a video blackjack game, and/or any other video table game, among others. While gaming machine 10 can typically be adapted for live game play with a physically present player, it is also contemplated that such a gaming machine may also be adapted for game play with a player at a remote gaming terminal. Other features and functions may also be used in association with gaming machine 10, and it is specifically contemplated that the present invention can be used in conjunction with such a gaming machine or device that might encompass any or all such additional types of features and functions. Gaming machines such as these and other variations and types are made by many manufacturers, such as, for example, IGT of Reno, Nev.

In addition, the gaming devices of the present invention may be compatible with game results that are centrally determined. For example, in bingo games, keno games or lottery games, the outcomes for a game played on the gaming machine may be generated on a remote server and then distributed to the gaming machine 10. The play of the game on the gaming machine 10 may comprise revealing the outcome of the remotely determined game outcome to the player. For example, the results of a bingo game may be translated to look like a "slot" game when played the player. Additional details of centrally determined games compatible with the present invention are described in co-pending U.S. application Ser. No. 10/995,636, filed Nov. 22, 2004 and titled "Class II/Class III Hybrid Gaming Machine, Systems and Methods," which is incorporated herein by reference in its entirety and for all purposes.

With respect to electronic gaming machines in particular, the electronic gaming machines made by IGT are provided with special features and additional circuitry that differentiate them from general-purpose computers, such as a laptop or desktop personal computer ("PC"). Because gaming machines are highly regulated to ensure fairness, and in many cases are operable to dispense monetary awards of millions of dollars, hardware and software architectures that differ significantly from those of general-purpose computers may be implemented into a typical electronic gaming machine in order to satisfy security concerns and the many strict regulatory requirements that apply to a gaming environment. A general description of many such specializations in electronic gaming machines relative to general-purpose computing machines and specific examples of the additional or different components and features found in such electronic gaming machines will now be provided.

At first glance, one might think that adapting PC technologies to the gaming industry would be a simple proposition, since both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

Accordingly, one difference between gaming machines and common PC based computers or systems is that gaming machines are designed to be state-based systems. In a state-based system, the system stores and maintains its current state in a non-volatile memory, such that in the event of a power failure or other malfunction the gaming machine will return to its current state when the power is restored. For instance, if a player were shown an award for a game of chance and the power failed before the award was provided, the gaming machine, upon the restoration of power, would return to the state where the award was indicated. As anyone who has used a PC knows, PCs are not state machines, and a majority of data is usually lost when a malfunction occurs. This basic requirement affects the software and hardware design of a gaming machine in many ways.

A second important difference between gaming machines and common PC based computer systems is that for regulation purposes, the software on the gaming machine used to generate the game of chance and operate the gaming machine must be designed as static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulator in a particular jurisdiction and installed in the presence of a person representing the gaming jurisdiction. Any change to any part of the software required to generate the game of chance, such as, for example, adding a new device driver used by the master gaming controller to operate a device during generation of the game of chance, can require a new EPROM to be burnt, approved by the gaming jurisdiction, and reinstalled on the gaming machine in the presence of a gaming regulator. Regardless of whether the EPROM solution is used, to gain approval in most gaming jurisdictions, a gaming machine must demonstrate sufficient safeguards that prevent an operator of the gaming machine from manipulating hardware and software in a manner that gives the operator an unfair or even illegal advantage over a player. The code validation requirements in the gaming industry affect both hardware and software designs on gaming machines.

A third important difference between gaming machines and common PC based computer systems is that the number and kinds of peripheral devices used on a gaming machine are not as great as on PC based computer systems. Traditionally in the gaming industry, gaming machines have been relatively simple in the sense that the number of peripheral devices and the number of functions on the gaming machine have been limited. Further, the functionality of a gaming machine tends to remain relatively constant once the gaming machine is deployed, in that new peripheral devices and new gaming software is infrequently added to an existing operational gaming machine. This differs from a PC, where users tend to buy new and different combinations of devices and software from different manufacturers, and then connect or install these new items to a PC to suit their individual needs. Therefore, the types of devices connected to a PC may vary greatly from user to user depending on their individual requirements, and may also vary significantly over time for a given PC.

Although the variety of devices available for a PC may be greater than on a gaming machine, gaming machines still have unique device requirements that differ from a PC, such as device security requirements not usually addressed by PCs. For instance, monetary devices such as coin dispensers, bill validators, ticket printers and computing devices that are used to govern the input and output of cash to a gaming machine have security requirements that are not typically addressed in PCs. Many PC techniques and methods developed to facilitate device connectivity and device compatibility do not address the emphasis placed on security in the gaming industry. To address some of these issues, a number of hardware/software components and architectures are utilized in gaming machines that are not typically found in general-purpose computing devices, such as PCs. These hardware/software components and architectures include, but are not limited to, items such as watchdog timers, voltage monitoring systems, state-based software architectures and supporting hardware, specialized communication interfaces, security monitoring, and trusted memory.

A watchdog timer is normally used in IGT gaming machines to provide a software failure detection mechanism. In a normal operating system, the operating software periodically accesses control registers in a watchdog timer subsystem to "re-trigger" the watchdog. Should the operating software not access the control registers within a preset timeframe, the watchdog timer will time out and generate a system reset. Typical watchdog timer circuits contain a loadable timeout counter register to allow the operating software to set the timeout interval within a certain time range. A differentiating feature of some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. IGT gaming machines, however, typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT gaming machine game software is to use a state machine. Each function of the game (e.g., bet, play, result) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, or the like. This is critical to ensure that correct wagers and credits are preserved. Typically, battery backed RAM devices are used to preserve this critical data. These memory devices are not used in typical general-purpose computers. Further, IGT gaming computers normally contain additional interfaces, including serial interfaces, to connect to specific subsystems internal and external to the gaming machine. The serial devices may have electrical interface requirements that differ from the "standard" EIA RS232 serial interfaces provided by general-purpose computers. These interfaces may include EIA RS485, EIA RS422, Fiber Optic Serial, optically coupled serial interfaces, current loop style serial interfaces, and the like. In addition, to conserve serial interfaces internally in the gaming machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this. In addition, security monitoring circuits detect intrusion into an IGT gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, such as by software for reading status registers. This can trigger event log entries and further data authentication operations by the gaming machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the gaming machine. The code and data stored in these devices may include, for example, authentication algorithms, random number generators, authentication keys, operating system kernels, and so forth. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents is a separate third party verification device. Once the trusted memory device is verified as authentic, and based on the approval of verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. In addition to the basic gaming abilities provided, these and other features and functions serve to differentiate gaming machines into a special class of computing devices separate and distinct from general-purpose computers.

Moving to FIG. 2, an alternative gaming machine according to one embodiment of the present invention is similarly illustrated in perspective view. Like gaming machine 10 above, gaming machine 100 also includes a top box 111 and a main cabinet 112, one or both of which can comprise an exterior housing arranged to contain a number of internal gaming machine components. Many features can also be the same or similar to corresponding features in gaming machine 10, such as a main door 120, a primary video display monitor 126 and one or more speakers 132.

As can be seen, however, top box 111 is somewhat different than the top box 11 of exemplary gaming machine 10 above. Top box 111 contains a video display 140 surrounded by a mechanically driven rotatable object 160. The rotatable object 160 has the ability to rotate around the video display 140. The rotatable object 160 rotates around an axis 150 that is substantially horizontal with respect to an ordinary upright position of the gaming machine 100. The direction of rotation may include clockwise, counter-clockwise or combinations thereof.

The present invention is not limited to this orientation of axis 150. For example, an angle of the axis of rotation 150 relative to a front viewing surface of the gaming machine may be varied. For instance, when mounted in a top box, the axis 150 may be tilted down to change a viewing angle of the rotatable object relative to a player playing at the gaming machine 10. As is generally known in the art, many standard slot machines have gaming reels that rotate about an axis 151 that is substantially horizontal with respect to an ordinary upright position of the gaming machine.

Top box 111 may also comprise a bonus indicator or light, which can be used to indicate whenever the gaming machine enters a bonus mode. Accordingly, it will be readily appreciated that this indicator can be a light, a series of lights, an arrow or other pointer, and/or any other convenient bonus indicator.

As shown in the particular embodiment illustrated, top box 111 contains various components to facilitate the play of a bonus game associated with a main game played on gaming machine 100. In one embodiment, an outcome or series of outcomes on a main game or games played on gaming machine 100 can result in the ability of a player to play in a bonus game on the top box 111 of the gaming machine. Other ways of accessing such a bonus game might also be possible, as desired by a given gaming operator. In one embodiment, the play of the bonus game involves a virtual rotation of images on the inner video display and a physical rotation of the rotatable object. Further details of the combination inner video display and the rotatable object are provided with respect to the detailed figure below.

Figure 2B:
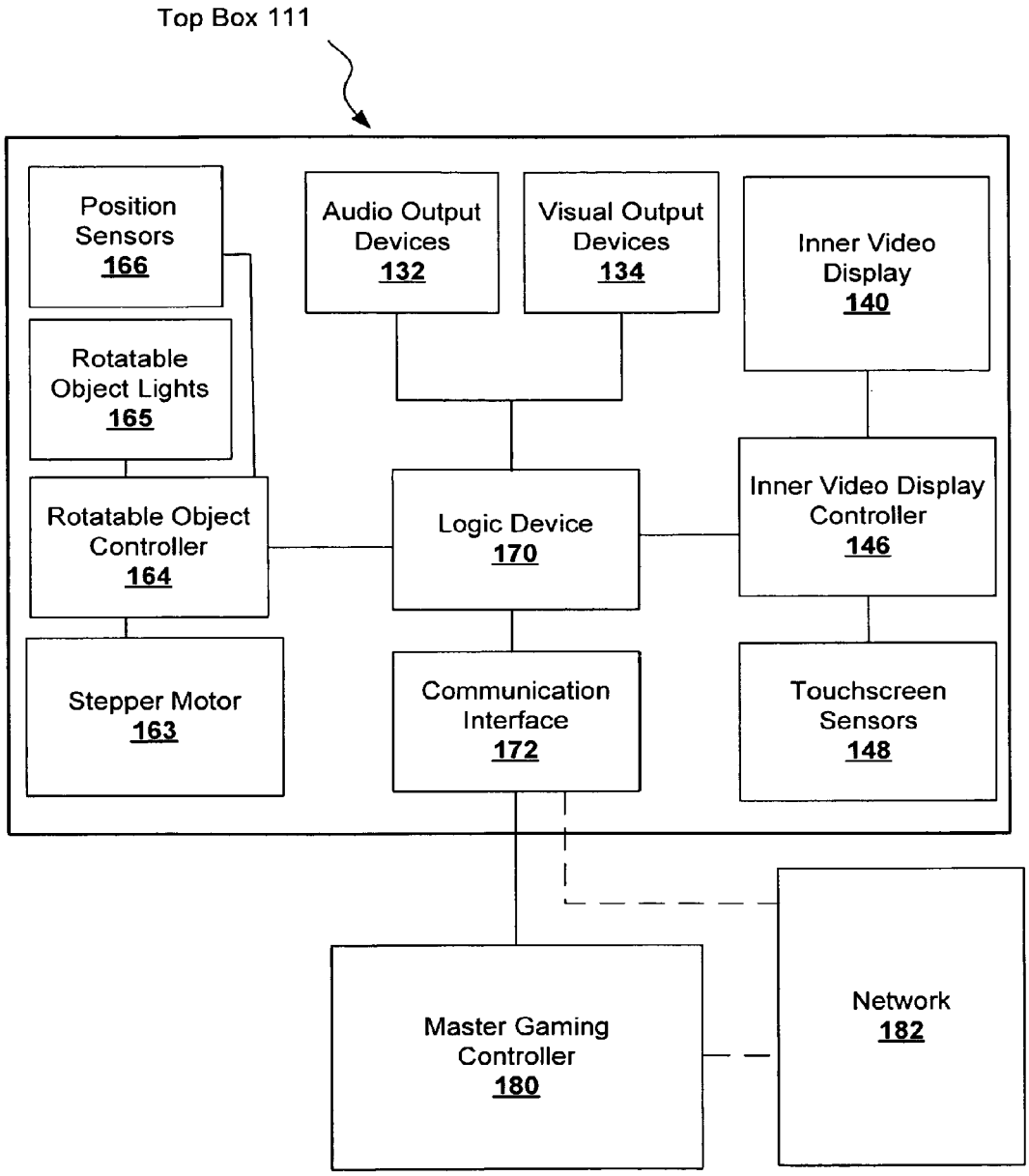
FIG. 2B illustrates a block diagram depicting a more detailed example of a top box having the inner video display and the outer mechanized rotatable device shown in FIG. 2.

FIG. 2B illustrates a block diagram depicting a more detailed example of a top box 111 having the inner video display 140 and the outer mechanized rotatable device 160 shown in FIG. 2. It will be understood that this block diagram is merely exemplary and illustrative in nature, such that some blocks might be removed, others might be added, and the position of any blocks or groups of blocks might be altered. Located within the top box 111 is a communication interface 172 that translates data between the logic device 170 and the MGC 180, the network 182 or a combination of both. The logic device 170 then receives data that initializes the game play program for the inner video display 140 and the outer mechanized rotatable device 160. The logic device 170 would then transmit the corresponding data to the inner video display controller 146 and the rotatable object controller 164.

Based on the data received at the inner video display controller 146, the inner video display 140 is configured to display a corresponding static or animated sequence of images. The inner video display controller 146 also communicates with touchscreen sensors 148. Once the touchscreen sensors 148 senses the player's input, the touchscreen sensors 148 are adapted to notify the inner video display controller 146. The inner video display controller 146 would communicate the notification to either the MGC 180, the network 182 or the combination of both. The MGC 180, the network 182 or a combination of both would then relay data back to the inner video controller 146. Accordingly, based on the relayed data, the inner video display controller 146 would be adapted to reconfigure the inner video display 140 to display a new set of corresponding static or animated sequence of images. It will be appreciated that the inner video display controller 146 could be eliminated and the inner video display 140 and the touchscreen sensors 148 could communicate directly to the logic device 170. It will also be readily appreciated that the inner video display 140 may not have touchscreen capabilities.

Based on the data received at the rotatable object controller 164, the rotatable object 160 (see FIG. 2) is adapted to rotate through the use of the stepper motor 163. The stepper motor 163 has the ability to rotate a ring gear where the ring gear acts as the rotatable object 160. The position of the ring gear can be determined through the use of position sensors 166, such as light sensors, bar code readers or symbol readers. Once the rotatable object controller 164 has received information from the position sensors 166, the rotatable object controller can communicate the position data to the MGC 180, the network 182 or the combination of both. The MGC 180, the network 182 or a combination of both would then relay data back to the rotatable object controller 164, where the data can relate to the spinning of the rotatable object 160 or a new desired ending position for the rotatable object 160. The rotatable object controller 164 also controls the rotatable object lights 165 correlated with the rotatable object 160. For example, the rotatable object 160 may be include a number of light paths that can be lit in different combinations to generate an appearance of different light sequences as well as other patterns on the rotatable device 160. It will be appreciated that the rotatable device controller 164 could be eliminated and the stepper motor 163, rotatable object lights 165 and the position sensors 166 could communicate directly to the logic device 170.

In an embodiment, the MGC 180 communicated to both the inner video controller 146 and the rotatable object controller 164 where the output is coordinated so that images displayed on the inner video display 140 appear to move in sync with the motion of the rotatable device 160. The logic device 170, the MGC 180 or the network 182 may coordinate the inner video controller 146 and the rotatable object controller 164 in order to enhance the player's playing experience.

In addition, the logic device communicates with an audio and video output devices 132, 134. The audio output device 132 is adapted to include speakers that deliver sound to the players based on an event at the top box 111. The audio output device 132 would communicate with a database having particular audio data located within at least one of the top box 111, the MGC 180 or the network 182. The video output device is adapted to include a secondary display and additional lights in order to draw players to play the gaming machine and to keep the player entertained while playing. The MGC 180, the logic device 170 or the network 182 could have the ability to control the visual output devices 134.

Figure 3A:
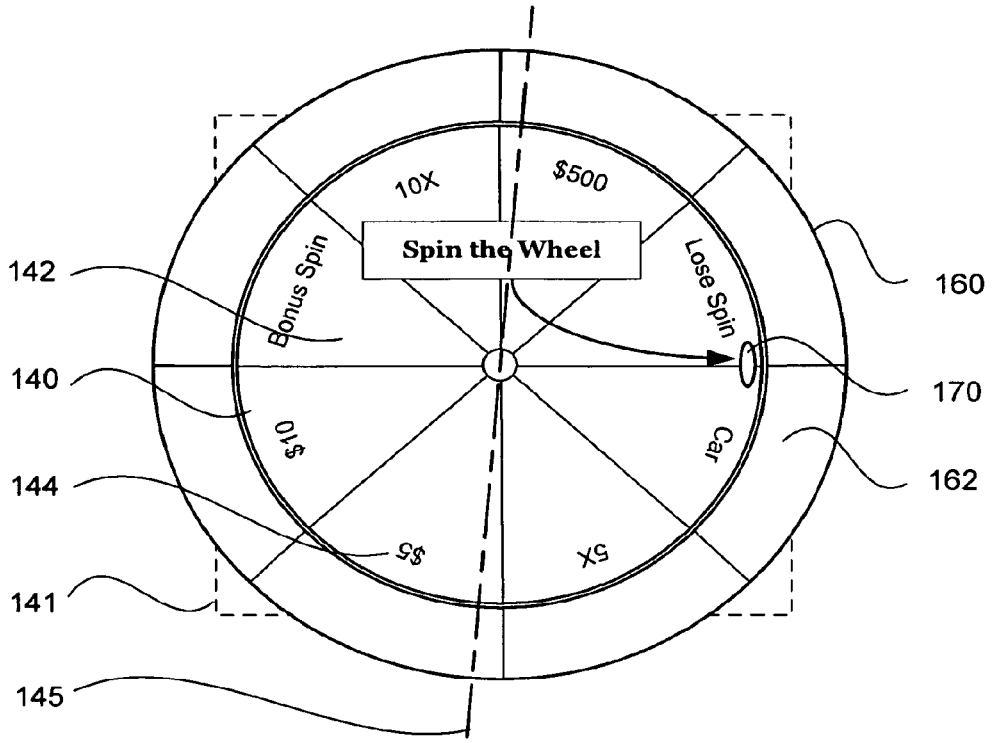
FIG. 3A illustrates in frontal elevation view an enlarged version of the inner video display and the outer mechanized rotatable wheel of the alternative gaming machine shown in FIG. 2.

Continuing on to FIG. 3A, an enlarged version of the combination inner video display 140 and outer mechanized rotatable wheel 160 is shown in frontal elevation view. The inner video display is normally a rectangular-type display having boundaries 141, but can be any type of shape that current and future display technologies allow such as an elliptical or circular display. In particular, the inner video display presents a virtual wheel that is made up of a plurality of inner segments 142, each of which may have indicia 144 that could have a particular value. The indicia can be an award, a bonus multiplier, a progressive jackpot, a negative value, a bonus spin character, a loss of spin character, a blank space or a null character. On the other hand, the segments could have a virtual tile that would mask the indicia. Once selected, the indicia would be revealed to the game player. Although the depicted inner segments 142 are simple pie segments, it will be readily appreciated that the segments can be of any type of design.

The awards displayed on the inner video display as indicia are not limited to cash prizes. The inner video display may be used to display cash and non-cash prizes, such as merchandise and travel awards. The non-cash prizes that may be potentially awarded may be player selectable. Details of methods and apparatus for awarding non-cash prizes that may be employed with the present invention are described in co-pending U.S. application Ser. No. 09/515,717, filed on Feb. 29, 2000 and entitled "Name Your Prize Game Playing Methodology," which is incorporated herein in its entirety and for all purposes.

The outer mechanized wheel 160 surrounds the virtual wheel on the inner video display 140 and has the ability to rotate around the virtual wheel 140. In this particular embodiment, the outer wheel has outer segments 162 that match to the inner segments 142 of the virtual wheel on the inner video display 140. Similar shapes or colors can be used to match the two segments 142, 162. In particular embodiments, the lines denoting the segments on the outer mechanized wheel may be reconfigurable. For example, the outer mechanized wheel may be include a number of light paths that can be lit in different combinations to generate an appearance of different segments as well as other patterns on the outer mechanized wheel 160.

The inner video display 140 may extend below the segments of the outer mechanized wheel 160. The outer mechanized wheel 160 may be constructed of a transparent or translucent material that allows images generated on the inner video display 140 to be viewed through the outer mechanized wheel 160. These images may comprise indicia, symbols, patterns or other information that are viewable by the player. Further, the outer mechanized wheel 162 may include a cover (see FIG. 4A, item 450), such as a circular disc or a dome that covers the inner video display 140. The cover may rotate at the same rate as the outer mechanized wheel 160, may be static or may be able to rotate independently of the outer mechanized wheel 160.

In this particular embodiment and the following embodiments, the inner video display 140 has a plurality of touchscreen sensors; it will be readily appreciated that each embodiment can operate without the touchscreen capabilities. The touch screen sensor may be employed to allow a player to directly interact with both the virtual wheel presented on the inner video display 140 and the outer mechanized wheel 160. For example, the player may be provided the opportunity to initiate and affect the motion of the combination virtual and mechanized wheel by touching the designated spin area 170 on the inner wheel, i.e., the player can "spin" the wheel.

The designated spin area 170 gives the player the feeling of control when spinning the combination wheel, much like a contestant on the "Wheel of Fortune." In addition, the player may have the option to choose the direction the wheel spins. Further, the player may be allowed to affect a "spin" rate on the wheel during some portion of its motion. Depending on how the wheel is configured, a player provided input to the spin rate may or may not affect the final position of the outer mechanized wheel 160 or the wheel on the inner video display.

Once the player "spins" the wheel or the wheel is set in motion by another game event, the spinning of the virtual wheel on the inner video display 140 and the outer mechanized wheel 160 may be correlated so that the combination of wheels 140, 160 appear to move as one single wheel. In other embodiments, the outer mechanized wheel and the virtual wheel may rotate in different directions, the outer mechanized wheel may remain static while the virtual wheel appears to rotate or the outer mechanized may rotate while the virtual wheel remains static.

In other embodiments, the virtual wheel and the outer mechanized wheel 160 may start and stop their motions at different times. For example, the outer mechanized wheel may start to rotate, followed by the rotation of the virtual wheel. Then, the virtual wheel may stop its motion followed by the mechanized outer wheel stopping its motion.

In a particular embodiment, an event occurring on a first wheel may trigger an event on a second wheel. For example, first the outer mechanized wheel may start to rotate and stop at a position that indicates an additional bonus on the virtual wheel. In response, the virtual wheel on display 140 may appear to rotate and stop at a position for indicating an second bonus. In the present invention, the virtual wheel on display 140 is not limited to a single wheel. The virtual wheel on display 140 may comprise a plurality of concentric virtual wheels that may rotate in unison or independently of one another.

The motion of the outer mechanized wheel 160 and the virtual wheel on display 140 may be accompanied by various sounds. The sounds may be generated mechanically or output as stored sound effects. For example, a device that generates noise, such as a clacker, may be attached to the outer mechanized wheel. The clacker can generate noise as the outer mechanized wheel 160 rotates or a sound effect corresponding to a clacker may be stored on the gaming machine and output via an audio output device, such as a speaker as the mechanized wheel 160 rotates. Sound effects, such as noise from a clacker, may also be output from the gaming machine when the virtual wheel is displayed in motion on the inner video display 140. Other sound effects, such as music, may also accompany the operation of the combination wheel and video display.

The gaming machine's MGC can either communicate with the inner and outer wheel 140, 160 directly or by communicating to both a video display controller and a mechanized object controller. On the other hand, the player may decide not to directly "spin" the combination wheel within the specific time period. In that case, after a timeout, the MGC would automatically spin the combination wheel for the player. The gaming machine's MGC also can determine the outcome of the combination wheel either randomly using a random number generator (RNG) or pseudo-randomly using a RNG in combination with the "spin" from the player.

When the inner video display 140 is coupled to a touch screen sensor, then the motion of the a virtual wheel on the inner video display may affect the position of touch activated surfaces displayed on the display 140. Thus, the position of these touch activated surfaces is tracked by the MGC so that an input received from the touch screen sensor can be matched to a corresponding touch activated surface displayed on the inner video display 140. For example, when the player makes a selection using the touchscreen sensor after the wheel is finished spinning and is awarded a prize, the initial position of the touch activated surfaces on the inner video display may be different from the final position of the touch activated surfaces on the Thus, the MGC may determine the final position of the segments within the wheel. One method of determining the final position is by determining the initial position of at least one segment and determining the rotational velocity on the segment. Then the MGC can calculate the final position of the images based on the time, the initial position and the rotational velocity of the one or more electronic images. Next, the MGC re-coordinates the touch screen sensors that correspond to the final position of the images.

In a particular embodiment, a touch screen sensor may be provided on a surface that rotates, such as the outer mechanized wheel 160. In this instance, the MGC may determine the position of the outer mechanized wheel to determine a location where an input from the touch screen sensor is being received. This location may correspond to an indicia displayed on the inner video display 140. The outer mechanized wheel 160 may include position sensors, such as light sensors, bar code readers or symbol readers that allow the position of the outer mechanized wheel to be determined by the MGC.

The inner video display 140 provides flexibility to the gaming machine since the inner video display can be reconfigured. The inner video display 140 provides flexibility to the game designers since they will no longer be limited to a printed fixed wheel. The inner video display 140 can be altered to change the indicia 144 within the segments 142, to provide a different primary game, to provide different primary game jackpots, to provide a progressive jackpot and to allow players to change the wheel based on player preferences. The player can customize the wheel by altering the appearance of the wheel and the indicia on the wheel. The player preferences for the wheel could be customizable based on the current wagering session at the gaming machine or a predefined player preference associated with a player-tracking card. In addition, the indicia on the wheel can be changed based upon the amount that the player is wagering. Further, inner video display may be used to display video content other than virtual wheels, such as television programming, messages, advertising, movies and the like.

Figure 3B:
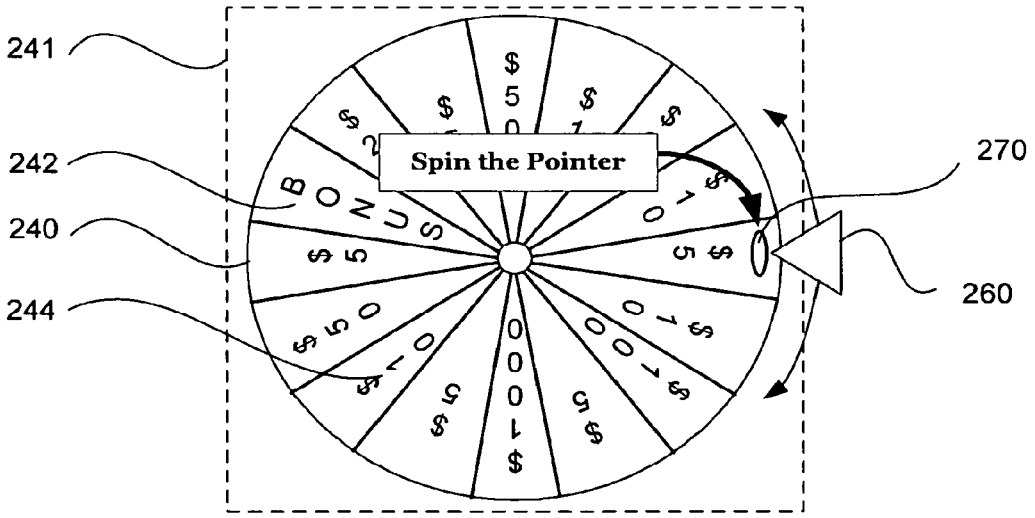
FIG. 3B illustrates in frontal elevation view an enlarged version of the inner video display and the outer mechanized rotatable pointer according to a second embodiment.

In the particular embodiment of FIG. 3B, the player has the opportunity to "spin" a mechanized pointer 260 around an inner video display 240 through the use of the designated spin area 270. For example, a player may run their finger across the designated spin area 270, which may be coupled to a touch screen sensor. The initial contact with the touch screen sensor and/or the rate that the player brushes the touch screen sensor may trigger the pointer to start its motion and affect one or more parameters of the pointers motion 260, such as a rotation rate.

The inner video display 240 is displayed to the game player, but has a boundary 241 that is hidden from the player. The inner video display 240 has a plurality of segments 242, each segment having indicia 244 that is associated with an award. Once the pointer 260 stops on a segment 242 having indicia 244, the gaming machine will either award the player or notify casino personnel to award the player. It will be readily appreciated that the player can designate the direction the pointer 260 rotates by properly touching the designated spin area 270. In addition, it will be readily appreciated that the segments 242 may appear to rotate around the display while the pointer 260 is being rotated. For example, the virtual rotation of the segments 242 can either rotate in the opposite direction than the pointer 260 or rotate at a slower rate than the pointer 260.

Figure 3C:
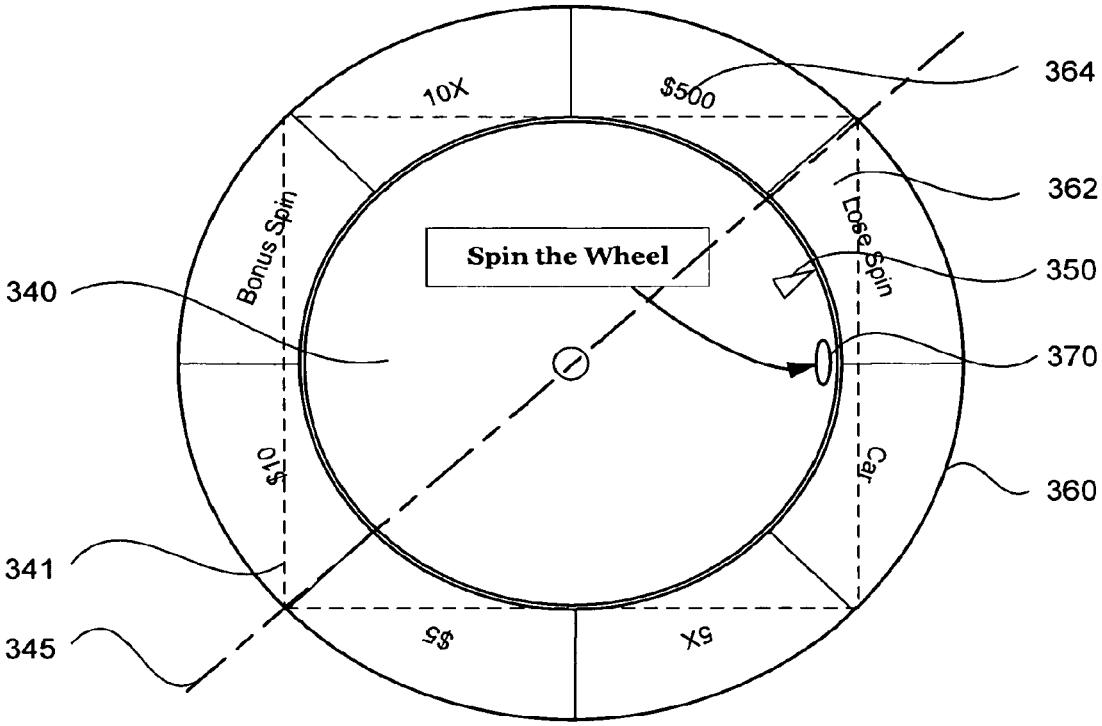
FIG. 3C illustrates in frontal elevation view an enlarged version of the inner video display and the outer mechanized wheel according to a third embodiment.

In the particular embodiment of FIG. 3C, the player has the opportunity to "spin" the outer mechanized wheel around an inner video display 340 through the use of the designated spin area 370. The inner video display has at least one virtual pointer 350 that points to a segment 362 on the outer mechanized wheel 360. Please note that multiple virtual pointers may be available on the inner video display and that a player could have the option to select which pointer in order to give the player a feeling of control.

Further, the player may be provided the opportunity to set in motion a plurality of these virtual pointers. For example, as part of a bonus award the player may be given the opportunity to set in motion one, two or three virtual points where the final position of each pointer indicates an award. These virtual pointers may appear to rotate independently of one another on the video display 240. In one embodiment, the pointers may rotate one after the other, i.e., the motion of second virtual pointer does not begin until the motion of first virtual pointer stops. In another embodiment, the motions of two or virtual pointers may occur at the same time.

The outer mechanized wheel has a plurality of segments 362, each segment having indicia 364 that is associated with an award. Once the outer mechanized wheel 360 stops rotating, the virtual pointer 350 will point to the segment 362 having the selected indicia 364. The gaming machine will either reward the player or notify casino personnel to award the player.

The indicia on wheel 360 can be reconfigurable by providing an organic light emitting display, a digital display, an electro-luminescent display or some other reconfigurable light source at the position where the indicia would be located. In other embodiments, it will be readily appreciated that the player may be allowed to provide an input that designates the direction the outer mechanized wheel 360 rotates. For example, as described above, the designated spin area 270 may be coupled to a touch screen sensor that allows the direction and motion of the outer mechanized wheel to be affected. In another embodiment, a bar or lever may be coupled to the outer mechanized wheel 360 that allows the player to provide a physical input, e.g., a push, that starts the wheel 360 in motion and may also affect the final position of the wheel 360 after it ceases it motion.

FIG. 4A-4B provide cross-sectional views for the combination inner video display 140 and the rotatable object 160 shown in FIG. 3A or 3C. In particular, FIG. 4A discloses a cross-sectional view of line 145 at FIG. 3A and FIG. 4B discloses a cross-sectional view of line 345 on FIG. 3C. In is readily appreciable that FIGS. 4A and 4B could be altered in a way to accommodate for FIG. 3B. In FIG. 4A, the outer mechanized object 430 is disposed above the inner video display 400. Within the gaming machine 100, frame 410 supports the inner video display 400. The inner video display 400 can be a cathode ray tube, a high resolution flat-panel LCD, a plasma/LED display, a touchscreen monitor or any other conventional or other type of appropriate video monitor. Coupled to the display 400 is the rotatable object 430. The rotatable object 430 acts as a ring gear and includes an outer molded ring that provides the segments 162, 362 and a transparent cover 450 that allows the player to view the inner video display 400. The cover 450 may comprise various surface profiles such as flat, dome shaped, convex, concave portions that vary of the surface of the cover.

When initiated, a stepper motor 420 rotates the rotatable object's ring gear around the video display. It will be readily appreciated that the rotatable object can have a lighting pattern built into the object that allows for lighting sequences to be displayed along with the combination video-mechanical wheel. In addition, it will be readily appreciated that the transparent cover 450 can utilize suspended particle technology and be non-transparent based on whether electricity is applied to the cover 450.

In FIG. 4B, the rotatable object 430 is built around the inner video display 400. Within the gaming machine 10, frame 410 supports the inner video display 400. The video display 400 can be a cathode ray tube, a high resolution flat-panel LCD, a plasma/LED display, a touchscreen monitor or any other conventional or other type of appropriate video monitor.

Built around the display 400 is the rotatable object 430. The rotatable object 430 includes a ring gear and includes an outer plastic molded ring 440 that provides the segments 162, 362. The outer plastic molded ring 440 extends out from the rotatable object 430 until it surpasses and covers portions of the inner video display 400. Since the plastic molded ring 440 overlaps the corners of the inner video display, the inner video display has an appearance of being a circular display (for example, see FIG. 3C). When initiated, a stepper motor (not shown) rotates the rotatable object's ring gear around the video display. It will be readily appreciated that the outer mechanized wheel can have a lighting pattern built into it for lighting sequences to be displayed along with the combination video-mechanical wheel. Further, it will be readily appreciated that the plastic molded rings can be made out of any reasonably suitable material.

As described above, the other mechanized rotatable object 430 may include a pointer. Further, one or more touch sensors may be coupled to the object 430. In one embodiment, previously described, a cover may be disposed above the display 400. The cover may be static or may be coupled to the stepper motor 420 or an additional stepper motor allowing the cover to be rotated.

Figure 5:
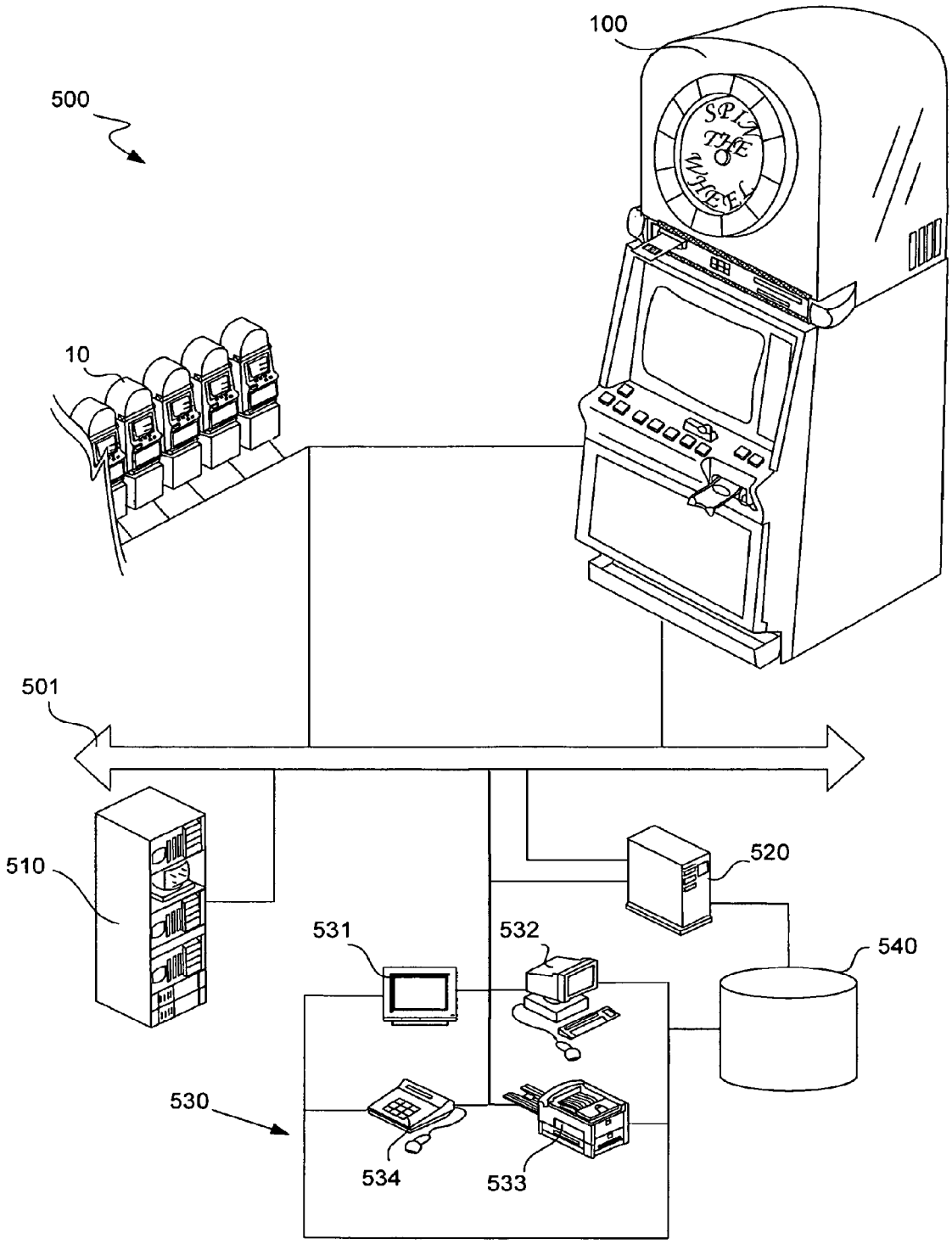
FIG. 5 illustrates a block diagram of an exemplary network infrastructure for providing various network components and a plurality of gaming machines such as the alternative gaming machine shown in FIG. 2.

Referring next to FIG. 5, a block diagram of an exemplary network infrastructure for providing various network components and a plurality of gaming machines such as the alternative gaming machine shown in FIG. 2 is illustrated. Gaming system 500 comprises several gaming machines, various communication items and a number of host-side components and devices adapted for use with a gaming environment and one or more gaming machines utilizing the inventive visual image display devices and methods disclosed herein. One or more gaming machines 10, 100 adapted for use in conjunction with gaming system 500 can be in a variety of locations, such as in banks on a casino floor, standing alone at a smaller independent establishment, or in isolation and not generally associated with any other gaming machines. These gaming machines may include one or more gaming machines 10 that do not utilize the inventive combination inner video display and the rotatable object and methods disclosed herein, as well as one or more gaming machines 100 that do so.

Gaming machines 10, 100 and any other game play servers or devices adapted for use in gaming system 500 are preferably connected to a host-side network via any desired operable connection means, such as by direct wiring, dial-up, Bluetooth® or other wireless arrangements, or a connection to an Internet server or Internet service provider, for example. Such gaming machines and devices are preferably connected to a host-side gaming network via connection to common bus 501. This common bus 501 can also connect a number of other networked devices, such as, for example, a general-purpose server 510, one or more special-purpose servers 520, a sub-network of peripheral devices 530, and/or a database 540. Such a general-purpose server 510 may be already present within an establishment for one or more other purposes in lieu of or in addition to the provision of specialized features or functions in association with one or more gaming machines or gaming systems that implement the present invention. Functions for such a general-purpose server can include, for example, both general and game specific accounting functions, payroll functions, general Internet and e-mail capabilities, switchboard communications, and reservations and other hotel and restaurant operations, as well as other assorted general establishment record keeping and operations.

In some instances, one or more specialized features or functions may also be associated with or performed by such a general-purpose server. For example, such a server may contain various server-based programs related to features or functions that administer or enhance the visual image displays and methods disclosed herein. This server may also be linked to one or more other gaming machines adapted for game play within an establishment, in some cases forming a network that includes all or substantially all of the gaming machines within that establishment. Communications can be exchanged from each adapted gaming machine to such programs or modules on the general-purpose server.

In another embodiment, gaming system 500 contains one or more special-purpose servers adapted to provide specialized features or functions in association with one or more gaming machines or gaming systems that implement the present invention. Such special-purpose servers can include, for example, a specialized gaming reel control server or program database, a specialized image or video presentation or file transfer server, and/or a specific game or downloadable game server, a specialized bonus game control server or program database, among others.

Such additional special-purpose servers are desirable for a variety of reasons, such as, for example, to lessen the burden on an existing general-purpose server or to isolate or some or all visual image file information from the general-purpose server and thereby limit the possible modes of access to such files and information. Alternatively, gaming system 500 can be isolated from any other network within the establishment, such that a general-purpose server 510 is essentially impractical and unnecessary. Under either embodiment of an isolated or shared network, a special-purpose server 520 is preferably connected to sub-network 530.

Peripheral devices in this sub-network may include, for example, one or more video displays 531, one or more user terminals 532, one or more printers 533, and one or more other digital input devices 534, such as a card reader or other security identifier, among others. Similarly, under either embodiment of an isolated or shared network, a special purpose server 520 or another similar component within a general-purpose server 510 also preferably includes a connection to a remote file database or other suitable storage medium 540. Database 540 is preferably adapted to store files containing data and information on various items, such as stored visual images, reel control algorithms, slot accounting, player accounting, player tracking, security, and/or other pertinent items, as desired. Files, data and other information on database 540 can be stored for backup purposes, and are preferably accessible at one or more system locations, such as at a general-purpose server 510, a special purpose server 520 and/or a cashier station or other sub-network location 530, as desired.

In one embodiment, database 540 is adapted to store snapshot images from the inner video display 140 in case of a power failure or for auditing purposes at the gaming machine. The snapshot images may compliment a usage history of rotatable devices described with respect to FIGS. 2-4B that are stored on the gaming machines, such as 100. The usage history may include, but is not limited to, frame captures of images displayed on the rotatable devices, information describing a position history of the device and awards provided using the device. Additional information describing game history and frame capture that may be used with the present invention are described in co-pending U.S. application Ser. No. 10/748,828, filed Jan. 15, 2004 and titled "Frame Capture of Actual Game Play," which is incorporated herein by reference in its entirety and for all purposes.

In addition, the gaming system 500 allows for the capability to provide a bonus scheme that allows a player to take part in a contest or competition, the success of which determines the player's bonus award, cited by U.S. Pat. No. 6,406,369, which has been incorporated herein. For example, a player reaching the bonus round at the gaming machine 100 could be pooled with other game players that reached the bonus round. The players then would take part in a contest or competition, such as a networked version of the Wheel of Fortune® game show, until a winner is determined. The competition would be displayed on either the video display monitor 26 or the inner video display 140.

Figure 6:
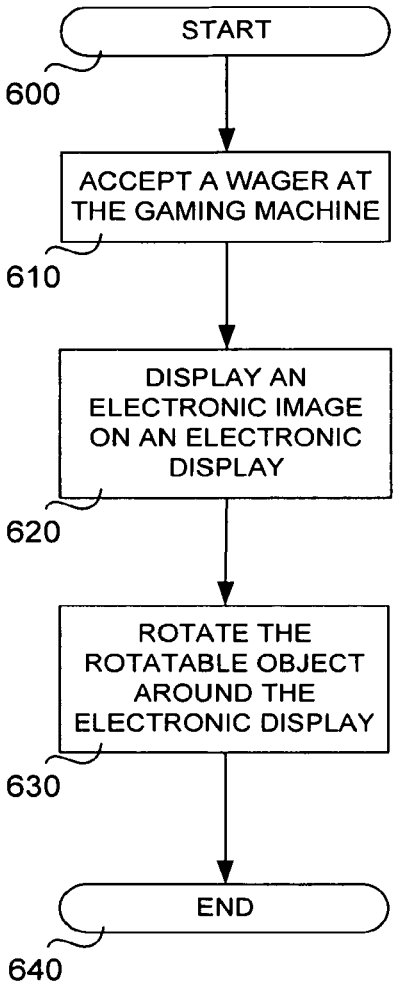
FIG. 6 illustrates a flowchart of one method of invoking the combination inner video display and the rotatable object shown in FIG. 2 according to one embodiment of the present invention.

Turning now to FIG. 6, a flowchart conveying one method of invoking the combination inner video display and rotatable object shown in FIG. 2 according to an embodiment of the present invention is shown. Such a machine can be the gaming machine 100 illustrated in FIG. 2, a similar gaming machine or any other gaming machine that utilizes the inner video display and the mechanized rotatable object. While the provided flowchart may be comprehensive in some respects, it will be readily understood that not every step provided is necessary, that other steps can be included, and that the order of steps might be rearranged as desired by a given gaming manufacturer, operator, refrainer or repairperson. After an initial start step 600, the method begins with a process step 610, where a game machine accepts a wager. The wager may be made by inserting money or an indicia of credit into the gaming machine or by crediting a credit card, a debit card, a player tracking card having a monetary balance or by any other crediting means.

At subsequent process step 620 where the gaming machine displays an electronic image on an inner video display. The electronic image can be any suitable set of images or any sequence of images. The images can be indicia, player-selectable indicia, or animation. The images at the inner video display may be initiated by the gaming machine or by an outside server within the network. In addition, a separate video controller may control the images at the inner video display.

The method further proceeds with process step 630 where the gaming machine rotates the rotatable object around the inner video display. The rotatable object can be any suitable mechanized rotatable device, such as a wheel or a pointer. The rotatable object can be adapted to coordinate with the displaying of images on the inner video display at step 620. A separate rotatable object controller may control the rotatable object. A gaming machine's MGC or a server may coordinate the inner video controller and the rotatable controller in order to enhance the player's playing experience. In addition, process steps 620 and 630 can be utilized in both the primary game and the bonus game. Finally, the method will then conclude at end step 640.

Figure 7:
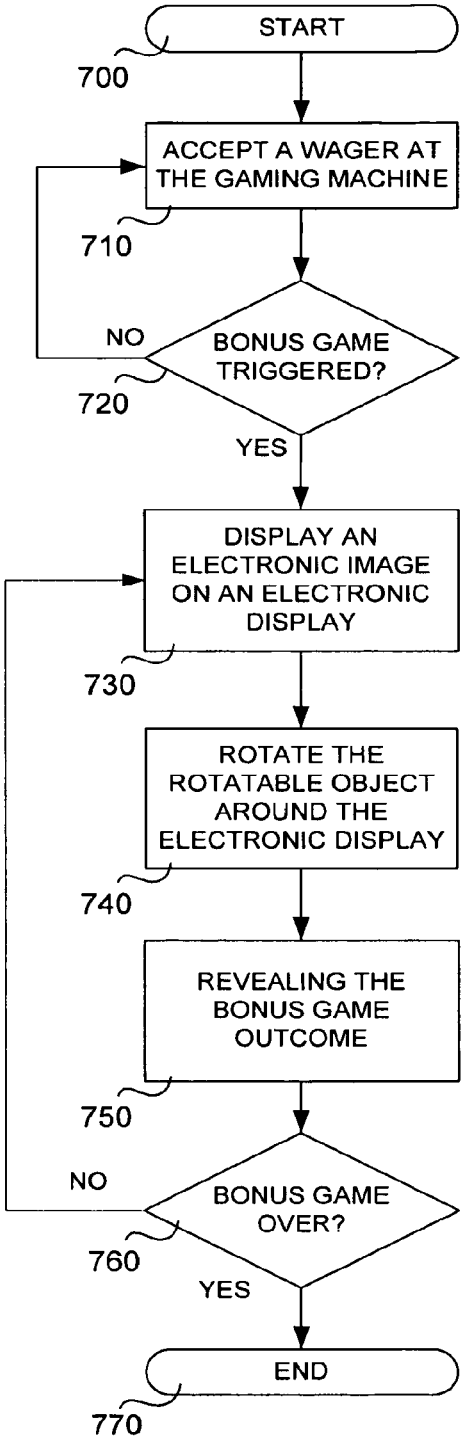
FIG. 7 illustrates a flowchart of one method of invoking a bonus game having the combination inner video display and the rotatable object shown in FIG. 2 according to one embodiment of the present invention.

Turning now to FIG. 7, a flowchart of one method of invoking the combination inner video display and rotatable object during a bonus game at the gaming machine. Such a machine can be the gaming machine 100 illustrated in FIG. 2, a similar gaming machine or any other gaming machine that utilizes the inner video display and the bonus object. It will be understood that this method is merely exemplary and illustrative in nature, such that some steps might be removed, others might be added, and the order or sequence of any steps or groups of steps might be altered. After an initial start step 700, the method begins with a process step 710, where a game machine accepts a wager. The wager may be made by inserting money into the gaming machine or by crediting a credit card, a debit card, a player tracking card having a monetary balance or by any other crediting means.

After the gaming machine accepts a wager at step 710, the method continues with a decision step 720 where the gaming machine determines whether a bonus game has been triggered. The gaming machine 100 or the server within the network may initiate the bonus game. Any suitable bonus triggering event can be utilized such as a combination of symbols appearing on a the payline of the gaming machine 100, the occurrence of a random event which is unrelated to the gaming outcome of the gaming machine 100, a function of the number of coins played and a function of accumulated value in the winnings at the gaming machine. If the bonus game is not triggered, the method would proceed back to accepting a wager at the gaming machine process step 710.

If the bonus game is triggered, the method would proceed to the process step 730 where the gaming machine displays an electronic image on an inner video display. The electronic image can be any suitable set of images or any sequence of images. The images can be indicia, player-selectable indicia, or animation. The images at the inner video display may be initiated by the gaming machine or by an outside server within the network. In addition, a separate and distinct inner video controller may control the images at the inner video display.

The method further proceeds with process step 740 where the gaming machine rotates the rotatable object around the inner video display. The rotatable object can be any suitable mechanized rotatable device, such as a pointer, a wheel or combinations thereof. The rotatable object can be adapted to coordinate with the displaying of images on the inner video display at step 730. A separate rotatable object controller may control the rotatable object. A gaming machine's MGC or a server may coordinate the inner video controller and the rotatable controller in order to enhance the player's bonus playing experience.

After rotating the rotatable object at process step 740, the method continues with a process step to reveal the corresponding bonus outcome of that particular bonus game sequence 750. This step reveals the player's outcome for the particular bonus game, where the outcome can be an award, a bonus multiplier, a progressive jackpot, a negative value, a bonus spin character, a loss of spin character, a blank space or a null character.

Prior to revealing the bonus game outcome step 750, the gaming machine is adapted to determine the bonus game outcome and determine how to reveal the bonus game outcome. Generally, the bonus game will be determined prior to the motion of the rotatable object step 740, but it will be appreciated that the bonus game outcome can be determined while the rotatable object is in motion.

At some point after determining the bonus game outcome, the gaming machine is adapted to determine how the bonus game outcome is to be revealed. This may include determining the final reconfigured electronic display, the final position of the rotatable object, the final positions of indicia on the rotatable object, or a combination of the three. In addition, the gaming machine has the ability to decide the intermediate paths between the initial and final position of the rotatable device and the initial and final symbols to be displayed on the inner video display. The intermediate paths and the bonus game outcome can be affected by player inputs received at the gaming machine. Accordingly, different light patterns and sound effects will be determined based on how the bonus game outcome is revealed and the revealing of the bonus game outcome.

After determining the bonus outcome at process step 750, the method proceeds to decision step 760 where the gaming machine determines whether the bonus game is over or not. The bonus game can be a single bonus game or a series of bonus games after a single bonus-triggering event ("bonus round"), depending upon the type of game. If the bonus game is not over, the method would proceed back to displaying an image at the inner video display process step 730. On the other hand, if the bonus game is over, the method will then conclude at end step 780.

Figure 8:
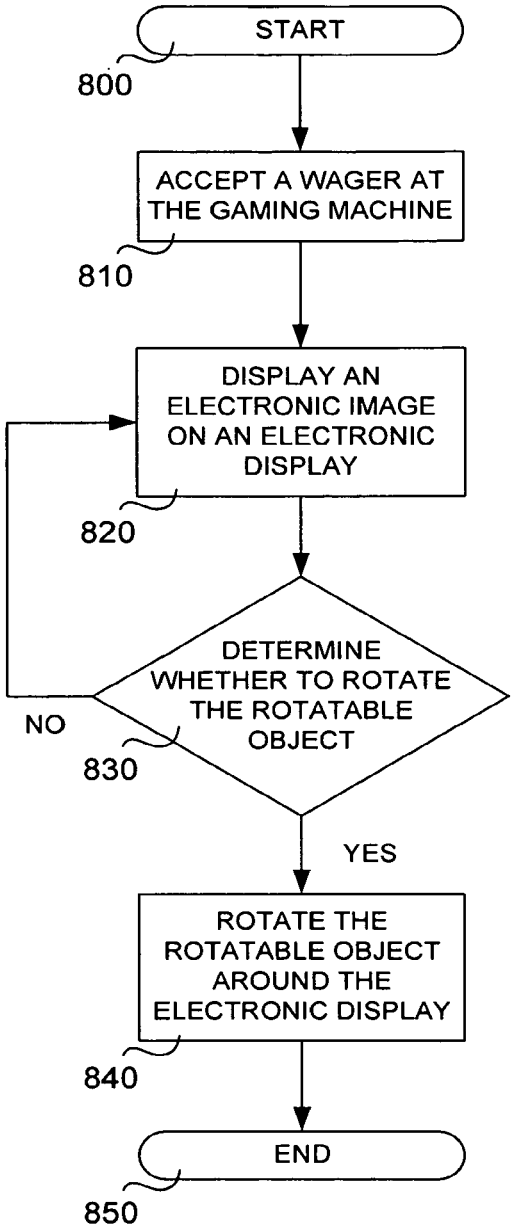
FIG. 8 illustrates a flowchart of one method of invoking the combination inner video display and the rotatable object shown in FIG. 2 according to one embodiment of the present invention.

Turning now to FIG. 8, a flowchart conveying one method of invoking the combination inner video display and rotatable object shown in FIG. 2 when the inner video display 140 acts as the primary video display monitor 126 and displays the primary game. Such a machine can be the gaming machine 100 illustrated in FIG. 2, a similar gaming machine or any other gaming machine that utilizes the inner video display and the rotatable object. While the provided flowchart may be comprehensive in some respects, it will be readily understood that not every step provided is necessary, that other steps can be included, and that the order of steps might be rearranged as desired by a given gaming manufacturer, operator, retrofitter or repairperson. After an initial start step 800, the method begins with a process step 810, where a game machine accepts a wager. The wager may be made by inserting money into the gaming machine or by crediting a credit card, a debit card, a player tracking card having a monetary balance or by any other crediting means.

At subsequent process step 820 where the gaming machine displays an electronic image on an inner video display. The electronic image can be any suitable set of images or any sequence of images. The images can be indicia, player-selectable indicia, animation or combinations thereof. The images at the inner video display may be initiated by the gaming machine or by an outside server within the network. In addition, a separate inner video controller may control the images at the inner video display.

The method continues to decision step 830 where the gaming machine determines whether to rotate the rotatable object. The determination may be based on an event within the display of the inner video display, the occurrence of a random event which is unrelated to the gaming outcome of the gaming machine 100, a function of the number of coins played and a function of accumulated value in the winnings at the gaming machine. If the machine decides not to rotate the rotatable object, then the method would continue back to display an image at process step 820. Please note that, as an alternative, the method could continue as far back as accept a wager at process step 810 or even depend on events or a combination of events that have occurred during previous games played on the gaming machine or other gaming machines If the gaming machine determines to rotate the rotatable object at decision step, the method further proceeds to process step 840 where the gaming machine rotates the rotatable object around the inner video display. The rotatable object can be any suitable mechanized rotatable device, such as a pointer or a wheel. The rotatable object can be adapted to coordinate with the displaying of images on the inner video display at step 820. A separate rotatable object controller may control the rotatable object. A gaming machine's MGC or a server may coordinate the inner video controller and the rotatable controller in order to enhance the player's bonus playing experience. In addition, process steps 820 and 840 can be utilized in both the primary game and the bonus game. Finally, the method will then conclude at end step 850.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A gaming system comprising:

at least one display device;

at least one input device;

a physical wheel defined by an inner radius and an outer radius, the physical wheel including a plurality of sections arranged along a circumference of the physical wheel between the inner radius and the outer radius, wherein the physical wheel has an interior defined by the inner radius;

an inner video display device visible through the interior of the physical wheel; and a master gaming controller with at least one processor and a memory communicatively connected with the at least one processor, the memory including machine-executable instructions for controlling the at least one processor to control the at least one display device, the at least one input device and the physical wheel to:

(a) display a play of a primary game responsive to receipt of a wager by the gaming system;

(b) upon an occurrence of a triggering event, enable physical contact from a source outside of the gaming system with the physical wheel to cause the physical wheel to rotate;

(c) randomly determine one of the sections of the physical wheel to indicate with an indicator displayed on the inner video display;

(d) cause the physical wheel to stop such that the randomly determined section is indicated by the indicator; and (e) display a game outcome based on the indicated section.

2. The gaming system of claim 1, further comprising a lever or bar connected with the physical wheel, wherein the lever or bar are configured to receive the physical contact from the source outside of the gaming system to the physical wheel and transfer force from the physical contact to the physical wheel.

3. The gaming system of claim 1, wherein the physical wheel is configured to rotate around a substantially vertical axis.

4. The gaming system of claim 1, wherein the physical wheel is configured to rotate around a substantially horizontal axis.

5. The gaming system of claim 1, further comprising a protective cover that at least partially covers the physical wheel.

6. The gaming system of claim 1, wherein the at least one processor is configured to randomly determine the one of the sections of the physical wheel to indicate after the physical wheel is set in motion.

7. The gaming system of claim 1, which includes a handle attached to and extending from the physical wheel.

8. The gaming system of claim 1, further comprising a touch screen sensor, wherein the touch screen sensor is configured to rotate with the physical wheel, and wherein the at least one processor is configured to cause the physical wheel to rotate in response to contact with the touch screen sensor.

9. A gaming system comprising:

at least one input device;

at least one display device;

a physical wheel defined by an inner radius and an outer radius, the physical wheel including an indicator located between the inner radius and the outer radius;

an inner video display device visible through a section of the physical wheel defined by the inner radius; and a master gaming controller with at least one processor and a memory communicatively connected with the at least one processor, the memory including machine-executable instructions for controlling the at least one processor, to control the at least one display device, the at least one input device, the physical wheel, and the indicator to:

(a) provide for play of a primary game upon receipt of a wager by the gaming machine;

(b) upon an occurrence of a triggering event, enable the player to physically engage the physical wheel to cause the physical wheel and indicator to rotate, (c) randomly determine a game outcome to indicate;

(d) stop rotation of the physical wheel and the indicator to cause an indication of the outcome; and (e) provide the player the game outcome.

10. The gaming system of claim 9, wherein when the at least one processor is configured to randomly determine the game outcome to indicate after the physical wheel is set in motion.

11. The gaming system of claim 9, wherein the at least one processor is configured to stop the rotation of the physical wheel or the indicator while the other of the physical wheel or indicator is moving.

12. The gaming system of claim 9, wherein the inner video display device is configured with regions corresponding to game outcomes, and wherein the indicator rotates with the physical wheel and indicates a region on the inner video display device indicating the game outcome when the physical wheel and indicator are stopped.

13. The gaming system of claim 9, wherein the inner video display device is configured to display the indicator, wherein the physical wheel is configured with regions corresponding to game outcomes, and wherein the indicator indicates a region on the physical wheel indicating the game outcome when the physical wheel and the indicator are stopped.

14. The gaming system of claim 13, wherein the physical wheel and indicator are configured to rotate in opposite directions.

15. A method, the method comprising:

rotating a physical wheel on a gaming machine, wherein the physical wheel is defined by an inner radius and an outer radius;

rotating a pointer displayed on an inner display of the gaming machine, wherein the inner display is visible through an inner area of the physical wheel, wherein the inner area of the physical wheel is defined by the inner radius;

determining a game outcome for the gaming machine;

stopping the physical wheel and the pointer to indicate the game outcome, wherein:

the pointer rotates with the physical wheel, the pointer and the physical wheel indicate the game outcome on an inner video display device when the pointer and the physical wheel are stopped, and the inner video display device is configured to be visible within the interior of the physical wheel.

* * * * *